US010204565B2

(12) United States Patent
Park et al.

(10) Patent No.: US 10,204,565 B2
(45) Date of Patent: Feb. 12, 2019

(54) ORGANIC LIGHT EMITTING DISPLAY PANEL HAVING A SENSING TRANSISTOR AND METHOD OF DRIVING THEREOF

(71) Applicant: LG DISPLAY CO., LTD., Seoul (KR)

(72) Inventors: Yong Kyu Park, Goyang-si (KR); Seokyu Jang, Goyang-si (KR); Chang Bok Lee, Suwon-si (KR)

(73) Assignee: LG Display Co., Ltd., Seoul (KR)

( * ) Notice: Subject to any disclaimer, the term of this patent is extended or adjusted under 35 U.S.C. 154(b) by 22 days.

(21) Appl. No.: 15/390,151

(22) Filed: Dec. 23, 2016

(65) Prior Publication Data

US 2017/0193923 A1 Jul. 6, 2017

(30) Foreign Application Priority Data

Dec. 31, 2015 (KR) ..... 10-2015-0191421

(51) Int. Cl.
*G09G 3/3291* (2016.01)
*G09G 3/3258* (2016.01)
*G09G 3/3233* (2016.01)

(52) U.S. Cl.
CPC ..... *G09G 3/3291* (2013.01); *G09G 3/3233* (2013.01); *G09G 3/3258* (2013.01); *G09G 2300/043* (2013.01); *G09G 2300/0819* (2013.01); *G09G 2300/0842* (2013.01); *G09G 2320/043* (2013.01)

(58) Field of Classification Search
CPC ..... G09G 3/3291
USPC ..... 345/694
See application file for complete search history.

(56) References Cited

U.S. PATENT DOCUMENTS

2007/0164937 A1 7/2007 Jung et al.
2007/0195020 A1 8/2007 Nathan et al.
2013/0050292 A1 2/2013 Mizukoshi
2014/0252988 A1 9/2014 Azizi et al.
2015/0187276 A1* 7/2015 Shim ..... G09G 3/3233 345/77
2015/0294626 A1 10/2015 Bi et al.
(Continued)

FOREIGN PATENT DOCUMENTS

CN 101527114 A 9/2009
CN 102737579 A 10/2012
CN 104732918 A 6/2015
(Continued)

OTHER PUBLICATIONS

Extended European Search Report, dated May 8, 2017, for European Application No. 16206597.3-1903, 9 pages.

*Primary Examiner* — Long D Pham
(74) *Attorney, Agent, or Firm* — Seed Intellectual Property Law Group LLP

(57) ABSTRACT

Disclosed are an organic light emitting display panel, an organic light emitting display device, and a method of driving the organic light emitting display device. The organic light emitting display panel, the organic light emitting display device, and the method of driving the organic light emitting display device having a subpixel structure and a gate line connection structure in which two types of scan transistors within each subpixel can be individually turned on and off and image driving and various types of sensing driving can be performed while the aperture ratio increases through the individual on and off of the scan transistors.

14 Claims, 20 Drawing Sheets

(56) References Cited

U.S. PATENT DOCUMENTS

| | | | | |
|---|---|---|---|---|
| 2015/0356920 | A1 | 12/2015 | Na et al. | |
| 2016/0098961 | A1* | 4/2016 | Han | G09G 3/3291 345/691 |

FOREIGN PATENT DOCUMENTS

| | | | |
|---|---|---|---|
| JP | 2005-91443 | A | 4/2005 |
| JP | 2009-526248 | A | 7/2009 |
| JP | 2015-108828 | A | 6/2015 |

* cited by examiner

Vth Sensing

Vsen Wave

A

8

A'

ORGANIC LIGHT EMITTING DISPLAY PANEL HAVING A SENSING TRANSISTOR AND METHOD OF DRIVING THEREOF

CROSS REFERENCE TO RELATED APPLICATION

This application claims priority from Korean Patent Application No. 10-2015-0191421, filed on Dec. 31, 2015, which is hereby incorporated by reference for all purposes as if fully set forth herein.

BACKGROUND

Technical Field

The present disclosure relates to an organic light emitting display panel, an organic light emitting display device, and a method of driving the organic light emitting display device.

Description of the Related Art

Recently, an organic light emitting display device is coming into the spotlight as a display device which has advantages such as a fast response rate, high light emitting efficiency, high luminance, and a wide viewing angle because of the use of an organic light emitting diode which emits light by itself.

Such an organic light emitting display device arranges subpixels including organic light emitting diodes and driving transistors for driving the organic light emitting diodes in a matrix form and controls brightness of subpixels selected by a scan signal according to a gray scale of data.

Circuit elements of the organic light emitting diodes and the driving transistors within each subpixel in an organic light emitting display panel have unique property values.

For example, the organic light emitting diode may have a threshold voltage as a property value, and the driving transistor may have a threshold voltage and mobility as property values.

The circuit element within each subpixel may deteriorate according to a driving time and thus has one or more variable property values. Since circuit elements within each subpixel have different deterioration degrees, characteristic variations may be generated between the circuit elements.

The characteristic variations between the circuit elements within the subpixel may cause non-uniform brightness of the organic light emitting display panel, thereby reducing a picture quality.

Accordingly, a compensation technology for sensing and compensating for a threshold voltage and mobility of a driving transistor of the organic light emitting display panel and a compensation technology for sensing and compensating for degradation of the organic light emitting diode have been developed.

However, in order to sense and compensate for the threshold voltage and the mobility of the driving transistor and sense and compensate for the degradation of the organic light emitting diode, subpixels should be designed to have a suitable structure.

Particularly, in order to sense the degradation of the organic light emitting diode, individually controlling the on and off states of two transistors for separately controlling voltage states of a gate node and a source node (or drain node) of the driving transistor is typically required.

In this case, two or more gate lines are needed on each subpixel line, which causes the aperture ratio of the organic light emitting display panel to deteriorate.

BRIEF SUMMARY

An objective of the present embodiments is to provide an organic light emitting display panel, an organic light emitting display device, and a method of driving the organic light emitting display device having a subpixel structure and a gate line structure in which the aperture ratio can increase and image driving and various types of sensing driving can be performed.

Another objective of the present embodiments is to provide an organic light emitting display panel, an organic light emitting display device, and a method of driving the organic light emitting display device having a subpixel structure and a gate line connection structure in which two types of scan transistors within each subpixel can be individually turned on and off through one gate line on each subpixel line.

Another objective of the present embodiments is to provide an organic light emitting display panel, an organic light emitting display device, and a method of driving the organic light emitting display device that can sense degradation of the organic light emitting diode within each subpixel through one gate line on each subpixel line.

In accordance with an aspect of the present disclosure, the present embodiments may provide an organic light emitting display device. The organic light emitting display device includes: an organic light emitting display panel on which a plurality of subpixels defined by a plurality of data lines and a plurality of gate lines are arranged; a data driver for driving the plurality of data lines; a gate driver for driving the plurality of gate lines; and a controller for controlling the data driver and the gate driver.

In such an organic light emitting display device, each subpixel may include an organic light emitting diode, a driving transistor for driving the organic light emitting diode, a switching transistor controlled by a scan signal applied to a gate node and electrically connected between a first node of the driving transistor and the data line, a sensing transistor controlled by a sensing signal applied to the gate node and electrically connected between a second node of the driving transistor and a reference voltage line, and a storage capacitor electrically connected between the first node and the second node of the driving transistor.

In such an organic light emitting display device, the plurality of gate lines may be each arranged on one subpixel line, and an $n+1^{th}$ gate line arranged on an $n+1^{th}$ subpixel line among the plurality of gate lines may be connected in common to a gate node of the switching transistor within each subpixel arranged on the $n+1^{th}$ subpixel line and a gate node of the sensing transistor within each subpixel arranged on an $n^{th}$ subpixel line.

In accordance with another aspect of the present disclosure, the present embodiments may provide an organic light emitting display panel. The organic light emitting display panel includes: a plurality of data lines for supplying a data voltage; a plurality of gate lines for supplying a gate signal; and a plurality of subpixels arranged in a matrix type.

In such an organic light emitting display panel, each subpixel may include an organic light emitting diode, a driving transistor for driving the organic light emitting diode, a switching transistor controlled by a scan signal applied to a gate node and electrically connected between a first node of the driving transistor and a data line, a sensing transistor controlled by a sensing signal applied to the gate node and electrically connected between a second node of the driving transistor and a reference voltage line, and a storage capacitor electrically connected between the first node and the second node of the driving transistor are arranged.

Further, in the organic light emitting display panel, the plurality of gate lines may be each arranged on one subpixel line.

In the organic light emitting display panel, an $n+1^{th}$ gate line arranged on an $n+1^{th}$ subpixel line among the plurality of gate lines may be connected in common to a gate node of the switching transistor within each subpixel arranged on the $n+1^{th}$ subpixel line and a gate node of the sensing transistor within each subpixel arranged on an $n^{th}$ subpixel line.

In accordance with another aspect of the present disclosure, the present embodiments may provide an image driving method of an organic light emitting display device in which a plurality of subpixels defined by a plurality of data lines and a plurality of gate lines are arranged. Each of the subpixels may include an organic light emitting diode, a driving transistor for driving the organic light emitting diode, a switching transistor controlled by a scan signal applied to a gate node and electrically connected between a first node of the driving transistor and the data line, a sensing transistor controlled by a sensing signal applied to the gate node and electrically connected between a second node of the driving transistor and a reference voltage line, a display panel on which a storage capacitor electrically connected between the first node and the second node of the driving transistor is arranged, a data driver for driving the plurality of data lines, and a gate driver for driving the plurality of gate lines.

Such an image driving method may include turning on the switching transistor within each subpixel arranged on an $n^{th}$ subpixel line by a turned-on level voltage of an $n^{th}$ scan signal output from an $n^{th}$ gate line arranged on the $n^{th}$ subpixel line; turning on the sensing transistor within each subpixel arranged on the $n^{th}$ subpixel line by a turned-on level voltage of an $n+1^{th}$ scan signal output from an $n+1^{th}$ gate line arranged on an $n+1^{th}$ subpixel line; and turning off the switching transistor within each subpixel arranged on the $n^{th}$ subpixel line by a turned-off level voltage of the $n^{th}$ scan signal output from the $n^{th}$ gate line.

In accordance with another aspect of the present disclosure, the present embodiments may provide an organic light emitting diode degradation sensing driving method of an organic light emitting display device in which a plurality of subpixels defined by a plurality of data lines and a plurality of gate lines are arranged. Each of the subpixels may include an organic light emitting diode, a driving transistor for driving the organic light emitting diode, a switching transistor controlled by a scan signal applied to a gate node and electrically connected between a first node of the driving transistor and the data line, a sensing transistor controlled by a sensing signal applied to the gate node and electrically connected between a second node of the driving transistor and a reference voltage line, a display panel on which a storage capacitor electrically connected between the first node and the second node of the driving transistor is arranged, a data driver for driving the plurality of data lines, and a gate driver for driving the plurality of gate lines.

Such an organic light emitting diode degradation sensing driving method may include: turning on the switching transistor within each subpixel arranged on an $n^{th}$ subpixel line by a turned-on level voltage of an $n^{th}$ scan signal output from an $n^{th}$ gate line arranged on the $n^{th}$ subpixel line, and turning on the sensing transistor within each subpixel arranged on the $n^{th}$ subpixel line by a turned-on level voltage of an $n+1^{th}$ scan signal output from an $n+1^{th}$ gate line arranged on an $n+1^{th}$ subpixel line; turning off the sensing transistor within a subpixel arranged on the $n^{th}$ subpixel line by a turned-off level voltage of the $n+1^{th}$ scan signal output from the $n+1^{th}$ gate line; and turning off the switching transistor within each subpixel arranged on the $n^{th}$ subpixel line by a turned-off level voltage of the $n^{th}$ scan signal output from the $n^{th}$ gate line, and turning-on the sensing transistor within a subpixel arranged on the $n^{th}$ subpixel line by a turned-on level voltage of the $n+1^{th}$ scan signal output from the $n+1^{th}$ gate line.

According to the present embodiments described above, it is possible to provide the organic light emitting display panel, the organic light emitting display device, and the method of driving the organic light emitting display device having the subpixel structure and the gate line structure in which the aperture ratio can increase and image driving and various types of sensing driving can be performed.

According to the present embodiments, it is possible to provide the organic light emitting display panel, the organic light emitting display device, and the method of driving the organic light emitting display device having the subpixel structure and the gate line connection structure in which two types of scan transistors within each subpixel can be individually turned on and off through one gate line on every subpixel line.

According to the present embodiments, it is possible to provide the organic light emitting display panel, the organic light emitting display device, and the method of driving the organic light emitting display device that can sense degradation of the organic light emitting diode within each subpixel through one gate line on each subpixel line.

BRIEF DESCRIPTION OF THE DRAWINGS

The above and other objects, features and advantages of the present disclosure will be more apparent from the following detailed description taken in conjunction with the accompanying drawings, in which.

DETAILED DESCRIPTION

Figure 1:
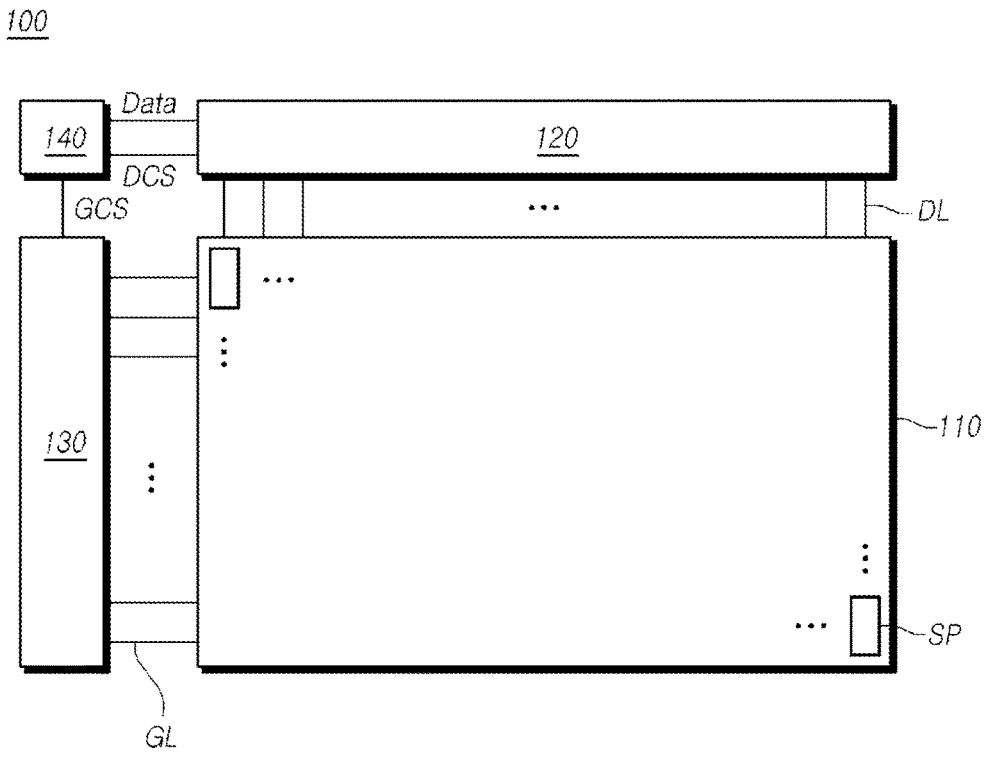
FIG. 1 is a system diagram illustrating an organic light emitting display device according to one or more embodiments of the present disclosure.

Hereinafter, some embodiments of the present disclosure will be described in detail with reference to the accompanying illustrative drawings. In designating elements of the drawings by reference numerals, the same elements will be designated by the same reference numerals although they are shown in different drawings. Further, in the following description of the present disclosure, a detailed description of known functions and configurations incorporated herein may be omitted when it may make the subject matter of the present disclosure rather unclear.

In addition, terms, such as first, second, A, B, (a), (b) or the like may be used herein when describing components of the present disclosure. Each of these terminologies is not used to define an essence, order or sequence of a corresponding component but used merely to distinguish the corresponding component from other component(s). In the case that it is described that a certain structural element is "connected to", "coupled to", or "in contact with" another structural element, it should be interpreted that one or more other structural elements may be "connected to", "coupled to", or "in contact with" the structural elements as well as that the certain structural element is directly connected to or is in direct contact with another structural element.

FIG. 1 is a configuration diagram illustrating a system of an organic light emitting display device 100 according to present embodiments.

Referring to FIG. 1, the organic light emitting display device 100 according to the present embodiments has a plurality of data lines (DL) and a plurality of gate lines (GL) arranged therein, and includes an organic light emitting display panel 110 in which a plurality of subpixels (SP) are arranged, a data driver 120 for driving the plurality of data lines (DL), a gate driver 130 for driving the plurality of gate lines (GL), and a controller 140 for controlling the data driver 120 and the gate driver 130.

The controller 140 supplies various types of control signals to the data driver 120 and the gate driver 130 to control the data driver 120 and the gate driver 130.

The controller 140 starts a scan according to timing implemented in each frame, switches input image data received from the outside according to a data signal format used in the data driver 120, outputs the switched image data, and controls data driving according to a proper time based on the scan.

The controller 140 may be a timing controller used in a general display technology or a control device that includes the timing controller and further performs another control function.

The data driver 120 drives the plurality of data lines (DL) by supplying a data voltage to the plurality of data lines (DL). The data driver 120 may also be referred to as a "source driver".

The data driver 120 may include at least one Source Driver Integrated Circuit (SDIC) and drive the plurality of data lines.

The gate driver 130 may sequentially supply scan signals to the plurality of gate lines (GL) and sequentially drive the plurality of gate lines (GL). The gate driver 130 may also be referred to as a "scan driver".

The gate driver 130 may include at least one Gate Driver Integrated Circuit (GDIC).

The gate driver 130 sequentially supplies scan signals of an on voltage or an off voltage to the plurality of gate lines (GL) according to a control of the controller 140.

When a particular gate line is opened by the gate driver 130, the data driver 120 converts the image data received from the controller 140 into an analog type data voltage and supplies the converted data voltage to the plurality of data lines (DL).

Although the data driver 120 is located on only one side (for example, the upper or lower side) of the organic light emitting display panel 110 in FIG. 1, the data driver 120 may be located on both sides (for example, the upper and lower side) of the organic light emitting display panel 110 according to a driving scheme, a panel design scheme, or the like.

Although the gate driver 130 is located at only one side (for example, left side or right side) of the organic light emitting display panel 110 in FIG. 1, the gate driver 130 may be located at both sides (for example, left side or right side) of the organic light emitting display panel 110 according to a driving scheme, a panel design scheme, or the like.

The controller 140 receives various timing signals including a vertical synchronization signal (Vsync), a horizontal synchronization signal (Hsync), an input Data Enable (DE) signal, a clock signal (CLK), and the like as well as the input image data from the outside (for example, a host system).

In order to control the data driver 120 and the gate driver 130, the controller 140 receives timing signals such as the vertical synchronization signal (Vsync), the horizontal synchronization signal (Hsync), the input DE signal, the clock signal, and the like to generate various control signals and output the generated control signals to the data driver 120 and the gate driver 130.

For example, in order to control the gate driver 130, the controller 140 outputs various Gate Control Signals (GCSs) including a Gate Start Pulse (GSP), a Gate Shift Clock (GSC), a Gate Output Enable (GOE) signal, and the like.

Further, in order to control the data driver 120, the controller 140 outputs various Data Control Signals (DCSs) including a Source Start Pulse (SSP), a Source Sampling Clock (SSC), a Source Output Enable (SOE) signal, and the like.

Each Source Driver Integrated Circuit (SDIC) included in the data driver 120 may be connected to a bonding pad of the organic light emitting display panel 110 in a Tape Automated Bonding (TAB) type or a Chip On Glass (COG) type or directly arranged on the organic light emitting display panel 110, and may be integrated and arranged on the organic light emitting display panel 110 according to the circumstances. Further, each SDIC may be implemented in a Chip On Film (COF) type in which the SDIC is mounted on a film connected to the organic light emitting display panel 110.

Each SDIC may include a shift register, a latch circuit, a Digital to Analog Converter (DAC), an output buffer, and the like.

Each SDIC may further include an Analog to Digital Converter (ADC) according to circumstances.

Each Gate Driver Integrated Circuit (GDIC) included in the gate driver 130 may be connected to a bonding pad of the organic light emitting display panel 110 in a TAB type or a COG type or implemented in a Gate In Panel (GIP) type and directly arranged on the organic light emitting display panel 110, and may be integrated and arranged on the organic light emitting display panel 110 according to the circumstances. Further, each GDIC may be implemented in a COF type in which the GDIC is mounted on a film connected to the organic light emitting display panel 110.

Each GDIC may include a shift register, a level shifter, and the like.

The organic light emitting display device 100 according to present embodiments may include at least one Source Printed Circuit Board (S-PCB) required for a circuit connection of at least one SDIC and a Control Printed Circuit Board (C-PCB) for mounting control components and various electronic devices.

At least one SDIC may be mounted on at least one S-PCB or a film, on which at least one SDIC is mounted, and may be connected to at least one S-PCB.

On the C-PCB, the controller 140 for controlling operations of the data driver 120 and the gate driver 130, and a power controller for supplying various voltages or currents to the organic light emitting display panel 110, the data driver 120, and the gate driver 130 or controlling the various voltages or currents to be supplied may be mounted.

At least one S-PCB and at least one C-PCB may be connected in a circuit manner through at least one connection member.

The connection member may be a Flexible printed Circuit (FPC), a Flexible Flat Cable (FFC), or the like.

At least one S-PCB and at least one C-PCB may be integrated into one printed circuit board.

Each subpixel (SP) arranged on the organic light emitting display panel 110 may include a circuit element such as a transistor.

For example, each subpixel (SP) may include circuit elements such as an Organic Light Emitting Diode (OLED), a driving transistor for driving the organic light emitting diode (OLED), and the like.

A type and number of circuit elements included in each subpixel (SP) may be variously determined according to a provided function and a design type.

Figure 2:
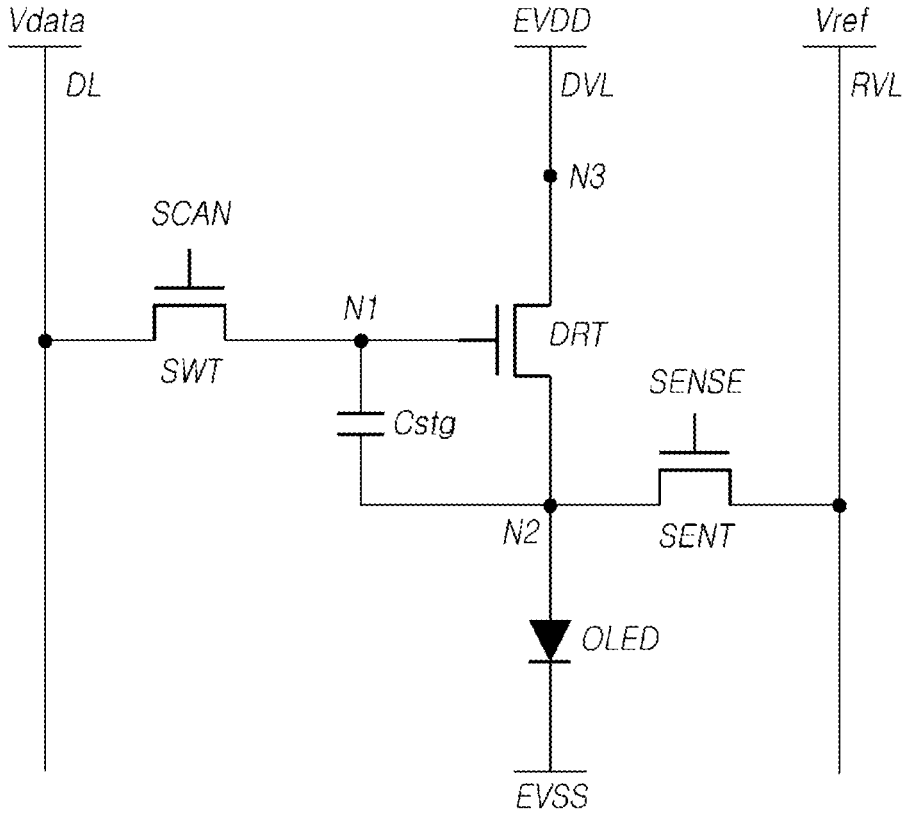
FIG. 2 illustrates an example of a subpixel structure of an organic light emitting display panel according to one or more embodiments.

FIG. 2 illustrates an example of a subpixel structure of the organic light emitting display panel 110 according to the present embodiments.

Referring to FIG. 2, in the organic light emitting display device 100 according to embodiments of the present disclosure, each subpixel may include an Organic Light Emitting Diode (OLED), a Driving Transistor (DRT) for driving the organic light emitting diode (OLED), a Switching Transistor (SWT) for transferring a data voltage to a first node (N1) corresponding to a gate node of the driving transistor (DRT), a Sensing Transistor (SENT) electrically connected between a second node (N2) of the driving transistor (DRT) and a Reference Voltage Line (RVL) that supplies a reference voltage (Vref), and a storage capacitor (Cstg) for maintaining a data voltage corresponding to an image signal voltage or a voltage corresponding to the data voltage during one frame time.

The organic light emitting diode (OLED) may include a first electrode (for example, an anode electrode), an organic layer, and a second electrode (for example, a cathode electrode).

The driving transistor (DRT) may drive the organic light emitting diode (OLED) by supplying a driving current to the organic light emitting diode (OLED).

In such a driving transistor (DRT), the first node (N1) may be electrically connected to a source node or a drain node of the switching transistor (SWT) and may be a gate node of the driving transistor (DRT). The second node (N2) may be electrically connected to the first electrode of the organic light emitting diode (OLED) and may be a source node or a drain node of the driving transistor (DRT). A third node (N3) may be electrically connected to a Driving Voltage Line (DVL) that supplies a driving voltage (EVDD) and may be a drain node or a source node of the driving transistor (DRT).

The switching transistor (SWT) may be electrically connected between the data line (DL) and the first node (N1) of the driving transistor (DRT) and may be controlled by a scan signal (SCAN) applied to the gate node of the switching transistor (SWT).

The switching transistor (SWT) may be turned on by the scan signal (SCAN) and may transfer a data voltage (Vdata) supplied from the data line (DL) to the first node (N1) of the driving transistor (DRT).

The sensing transistor (SENT) may be electrically connected between the second node (N2) of the driving transistor (DRT) and the Reference Voltage Line (RVL) and may be controlled by a sensing signal (SENSE), which is a kind of the scan signal, applied to the gate node of the sensing transistor (SENT).

The sensing transistor (SENT) may be turned on by the sensing signal (SENSE), and may apply the reference voltage (Vref) supplied through the reference voltage line (RVL) to the second node N2 of the driving transistor (DRT) or transfer the voltage of the second node (N2) of the driving transistor (DRT) to the reference voltage line (RVL).

The storage capacitor (Cstg) may be electrically connected between the first node (N1) and the second node (N2) of the driving transistor (DRT).

The storage capacitor (Cstg) is an intentionally designed external capacitor outside the driving transistor (DRT), as opposed to a parasitic capacitor (for example, Cgs or Cgd) corresponding to an internal capacitor existing between the second node (N2) and the first node (N1) of the driving transistor (DRT).

The driving transistor (DRT), the switching transistor (SWT), and the sensing transistor (SENT) may be implemented as n-type or a p-type transistors.

Figure 3:
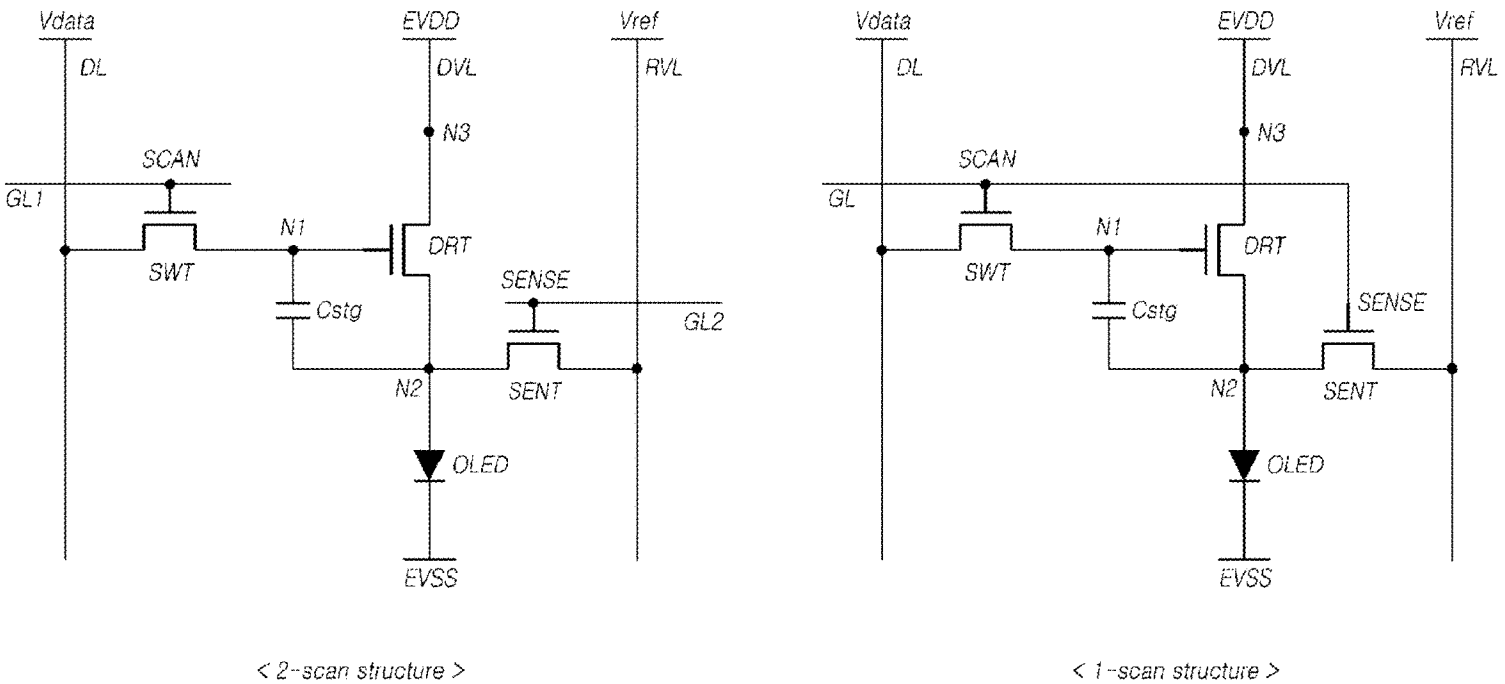
FIG. 3 illustrates a 1-scan structure and a 2-scan structure of a subpixel of an organic light emitting display panel according to one or more embodiments.

FIG. 3 illustrates a 1-scan structure and a 2-scan structure of a subpixel of the organic light emitting display panel 110 according to one or more embodiments.

Referring to FIG. 3, the gate node of the switching transistor (SWT) and the gate node of the sensing transistor (SENT) may be connected to different gate lines (GL1 and GL2). Such a gate line structure is referred to as the "2-scan structure".

In the 2-scan structure, a scan signal (SCAN) applied to the gate node of the switching transistor (SWT) and a sensing signal (SENSE) applied to the gate node of the sensing transistor (SENT) may be gate signals that are separate and distinct from each other.

Accordingly, the switching transistor (SWT) and the sensing transistor (SENT) may be individually turned on and off.

Referring to FIG. 3, the gate node of the switching transistor (SWT) and the gate node of the sensing transistor (SENT) may be connected to the same gate line (GL). Such a gate line structure is referred to as the "1-scan structure".

In the 1-scan structure, a scan signal (SCAN) applied to the gate node of the switching transistor (SWT) and a sensing signal (SENSE) applied to the gate node of the sensing transistor (SENT) may be the same gate signal.

Accordingly, the switching transistor (SWT) and the sensing transistor (SENT) cannot be individually turned on and off in the 1-scan structure.

In the aforementioned 2-scan structure, the switching transistor (SWT) and the sensing transistor (SENT) can be individually turned on and off, but the aperture ratio is low (e.g., as compared to the aperture ratio of the 1-scan structure) due to the presence of two separate gate lines (GL1, GL2).

In contrast, in the aforementioned 1-scan structure, the switching transistor (SWT) and the sensing transistor (SENT) cannot be individually turned on and off, but the aperture ratio is high, since only one gate line (GL) is present.

Meanwhile, as a driving time of each subpixel (SP) becomes longer, the organic light emitting display device 100 according to the present embodiments may experience degradation in the circuit elements such as the organic light emitting diode (OLED) and the driving transistor (DRT).

Accordingly, unique property values (for example, a threshold voltage, mobility, and the like) of the circuit elements such as the organic light emitting diode (OLED) and the driving transistor (DRT) may be changed over time.

The change in the property values of the circuit element causes a brightness change of the corresponding subpixel.

Further, an amount or degree of change of the property values of the circuit elements may be different according to a difference in the amount or degree of degradation of the circuit elements. That is, since respective circuit elements may experience varying degrees of degradation over time, the degree of change of a particular property value (e.g., a threshold voltage, mobility, etc.) of one circuit element (e.g., a driving transistor) in a subpixel may be different than the degree of change of that same property value in a corresponding circuit element of another subpixel.

A property value deviation between circuit elements due to the difference in the degrees of the property value changes of the circuit elements causes a brightness deviation between subpixels, thereby decreasing accuracy of brightness expression of the subpixel or generating a screen abnormality phenomenon such as non-uniform brightness.

The property value of the circuit element (hereinafter, also referred to as a "subpixel property value") may include, for example, a threshold voltage and mobility of the driving transistor (DRT), or may include a threshold voltage of the organic light emitting diode (OLED) according to circumstances.

The organic light emitting display device 100 according to one or more embodiments may provide a sensing function of sensing (e.g., measuring) property values of circuit elements or changes in the property values, and a compensation function of compensating for a property value deviation between subpixel circuit elements based on a sensing result.

Figure 4:
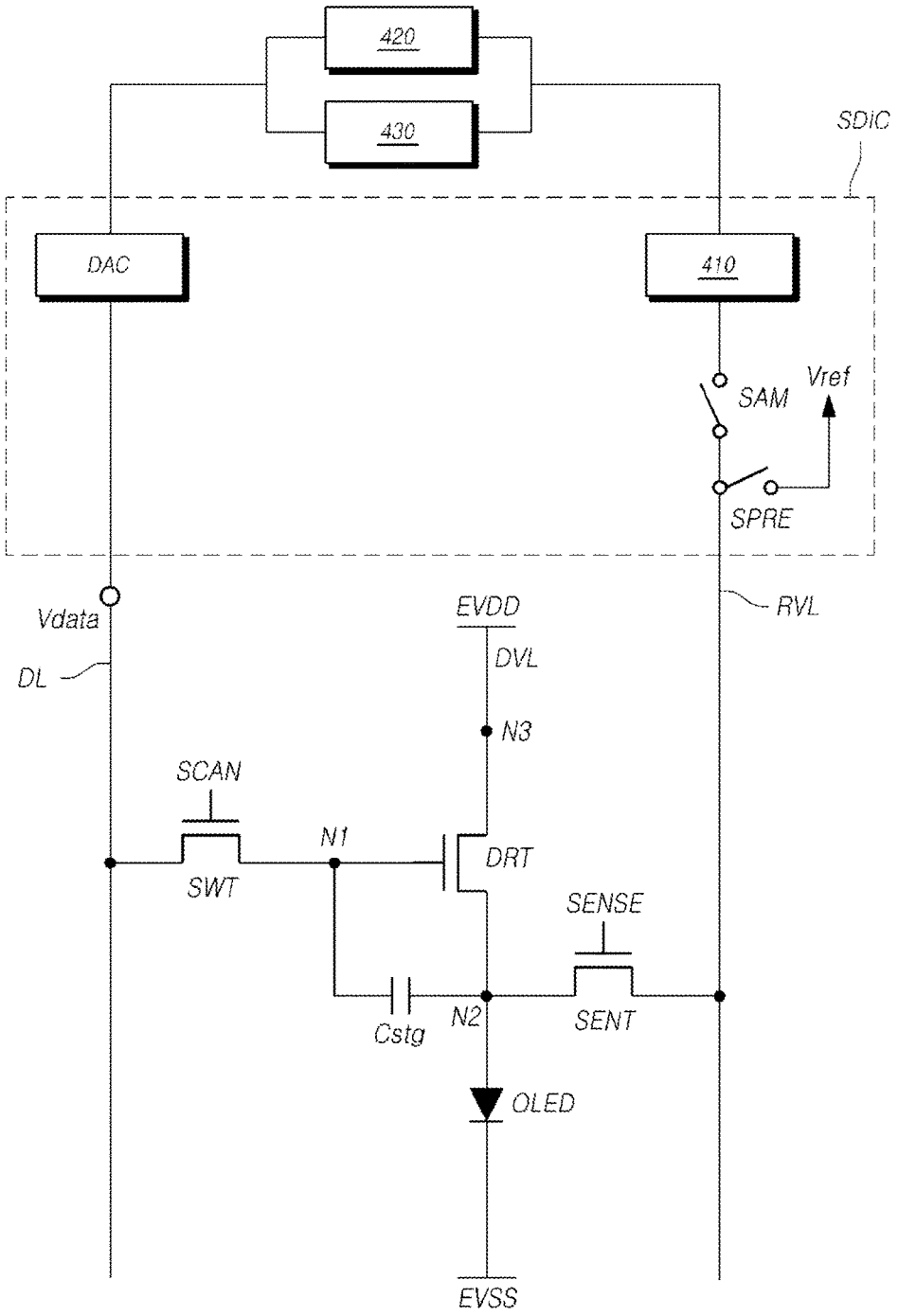
FIG. 4 illustrates an example of a compensation circuit of an organic light emitting display device according to one or more embodiments.

FIG. 4 illustrates an example of a compensation circuit of the organic light emitting display device 100 according to one or more embodiments.

Referring to FIG. 4, the organic light emitting display device 100 according to one or more embodiments may include a sensing unit 410 for sensing property values of circuit elements (e.g., a property value of the driving transistor and a property value of an organic light emitting diode) or changes in the property values and outputting sensing data, a memory 420 for storing the sensing data, and a compensation unit 430 for performing a compensation process of compensating a property value deviation between the circuit elements based on the sensing data.

The sensing unit 410 may include at least one Analog to Digital Converter (ADC).

Each ADC may be included inside the SDIC or may be included outside the SDIC according to circumstances.

The compensation unit 430 may be included inside the controller 140 or included outside the controller 140 according to circumstances.

The organic light emitting display device 100 according to one or more embodiments may further include an initialization switch (SPRE) and a sampling switch (SAM) in order to control sensing driving, that is, in order to control a voltage applying state of the second node (N2) of the driving transistor (DRT) within the subpixel (SP) to be in a state for sensing the subpixel property value.

Through the initialization switch (SPRE), whether to supply the reference voltage (Vref) to the reference voltage line (RVL) may be controlled.

When the initialization switch (SPRE) is turned on, the reference voltage (Vref) may be supplied to the reference voltage line (RVL) and then applied to the second node (N2) of the driving transistor (DRT) through the turned on sensing transistor (SENT).

Meanwhile, when the voltage of the second node (N2) of the driving transistor (DRT) becomes a voltage state in which a property value of the circuit element or a change in the property value is reflected (i.e., when the voltage at the second node (N2) is indicative of the property value or change in the property value), the voltage of the reference voltage line (RVL), which may be equipotential to the second node (N2) of the driving transistor (DRT) (e.g., by coupling the second node (N2) to the reference voltage line (RVL) through the turned on sensing transistor (SENT)), may become a voltage state in which the property value of the circuit element or the change of the property value is reflected. At this time, the voltage in which the property value of the circuit element or the change of the property value is reflected may be charged in a line capacitor formed on or coupled to the reference voltage line (RVL).

When the voltage of the second node (N2) of the driving transistor (DRT) becomes the voltage state in which the property value of the circuit element or the change of the property value is reflected, the sampling switch (SAM) may be turned on and thus the sensing unit 410 and the reference voltage line (RVL) may be connected.

Accordingly, the sensing unit 410 senses the voltage of the reference voltage line (RVL) (that is, the voltage of the second node (N2) of the driving transistor (DRT)) in the voltage state in which the property value of the circuit element or the change of the property value is reflected.

The sensing unit 410 converts the sensed voltage into a sensing value corresponding to a digital value and transmits sensing data including the sensing value.

The sensing data transmitted by the sensing unit 410 may be stored in the memory 420.

The compensation unit 430 may perform a compensation process to compensate for a deviation between circuit elements based on the sensing data stored in the memory 420.

Hereinafter, threshold voltage sensing driving and mobility sensing driving for the driving transistor (DRT) will be briefly described.

Figure 5:
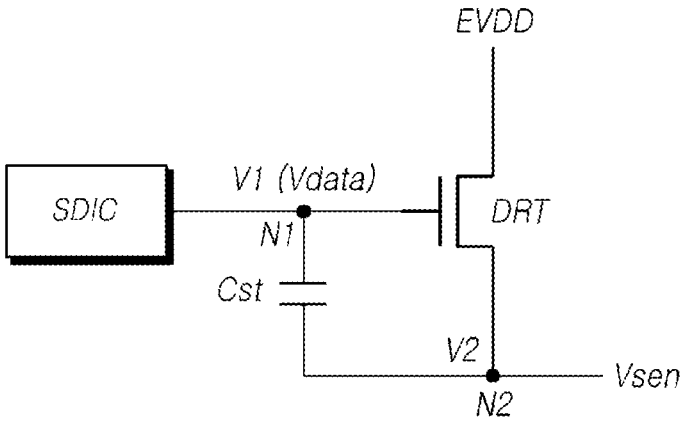
FIG. 5 is a diagram illustrating a threshold voltage sensing driving scheme of a driving transistor of an organic light emitting display device according to one or more embodiments.
Figure 5:
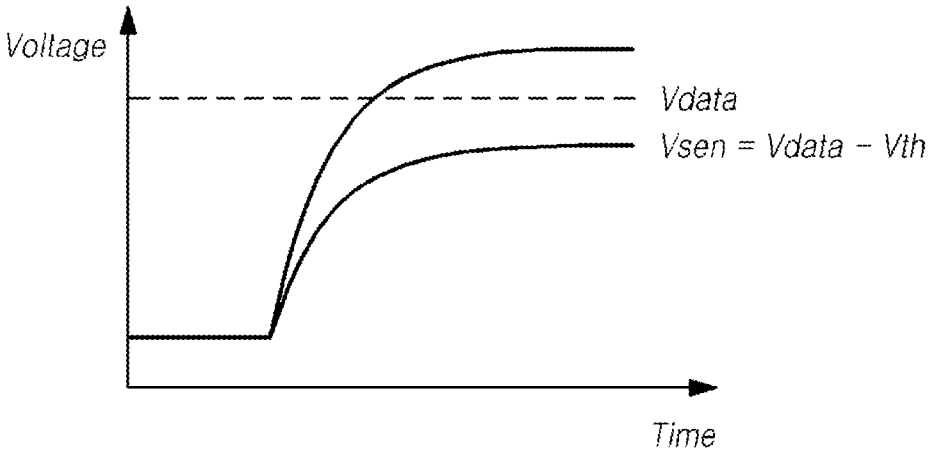

FIG. 5 illustrates a threshold voltage sensing driving method for the driving transistor (DRT) of the organic light emitting display device 100 according to one or more embodiments.

In threshold voltage sensing driving for the driving transistor (DRT), threshold voltages of the first node (N1) and the second node (N2) of the driving transistor (DRT) are initialized into the data voltage (Vdata) and the reference voltage (Vref) for threshold voltage sensing driving, respectively.

Thereafter, the initialization switch (SPRE) is turned off and the second node (N2) of the driving transistor (DRT) is floated.

Accordingly, the voltage of the second node (N2) of the driving transistor (DRT) increases.

The voltage of the second node (N2) of the driving transistor (DRT) increases and then an increase rate gradually decreases and becomes saturated.

The saturated voltage of the second node (N2) of the driving transistor (DRT) may correspond to a difference between the data voltage (Vdata) and a threshold voltage (Vth) or a difference between the data voltage (Vdata) and a threshold voltage deviation (ΔVth).

When the voltage of the second node (N2) of the driving transistor (DRT) is saturated, the sensing unit 410 senses the saturated voltage of the second node (N2) of the driving transistor (DRT), for example, through the sampling switch (SAM).

A voltage (Vsen) sensed by the sensing unit may be a voltage (Vdata−Vth) generated by subtracting the threshold voltage (Vth) from the data voltage (Vdata) or a voltage (Vdata−ΔVth) generated by subtracting the data voltage (Vdata) from the threshold voltage deviation (ΔVth).

Figure 6:
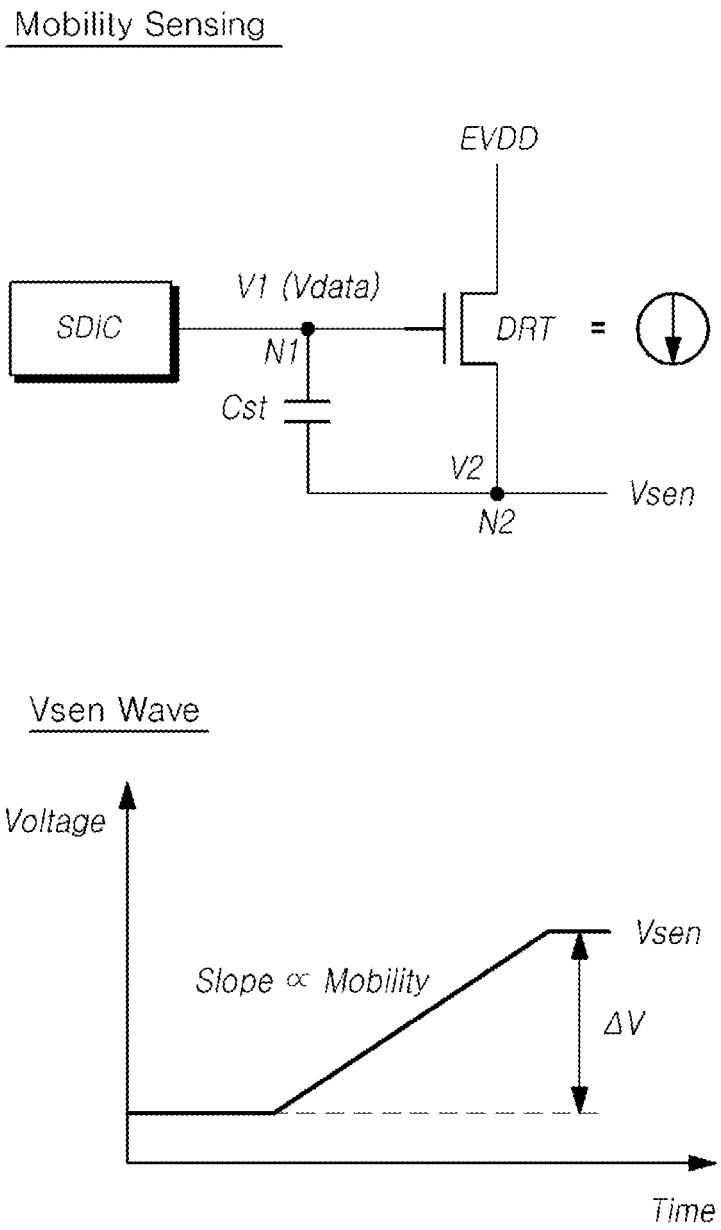
FIG. 6 is a diagram illustrating a mobility sensing driving scheme of a driving transistor of an organic light emitting display device according to one or more embodiments.

FIG. 6 illustrates a mobility sensing driving method for the driving transistor (DRT) of the organic light emitting display device 100 according to one or more embodiments.

In mobility sensing driving, the first node (N1) and the second node (N2) of the driving transistor (DRT) are initialized into the data voltage (Vdata) and the reference voltage (Vref) for mobility sensing driving, respectively.

Thereafter, the switching transistor (SWT) is turned off and the initialization switch (SPRE) is turned off, and thus the first node (N1) and the second node (N2) of the driving transistor (DRT) are floated.

Accordingly, the voltage of the second node (N2) of the driving transistor (DRT) starts increasing.

The voltage increase speed (a change (ΔV) in a voltage increase with respect to a time) of the second node (N2) of the driving transistor (DRT) varies depending on the current capability of the driving transistor (DRT), that is, mobility.

That is, a driving transistor (DRT) having higher current capability (mobility) has a voltage of the second node (N2) of the driving transistor (DRT) which steeply increases more quickly.

After the voltage of the second node (N2) of the driving transistor (DRT) has increased for a predetermined time, the sensing unit 410 senses the increased voltage (that is, a voltage of the reference voltage line (RVL) having increased along with the increase in the voltage of the second node (N2) of the driving transistor (DRT)) of the second node (N2) of the driving transistor (DRT).

According to the threshold voltage or mobility sensing driving, the sensing unit 410 converts the sensed voltage (Vsen) into a digital value for threshold voltage sensing or mobility sensing, and generates and outputs sensing data including the converted digital value (sensing value).

The sensing data output by the sensing unit 410 may be stored in the memory 420 and/or provided to the compensation unit 430.

The compensation unit 430 grasps property values (for example, a threshold voltage and mobility) of the driving transistor (DRT) within the corresponding subpixel or changes in the property values (for example, a change in the threshold voltage and a change in the mobility) of the driving transistor (DRT), based on the sensing data stored in the memory 420 or provided by the sensing unit 410, and performs a property value compensation process.

The changes in the property values of the driving transistor (DRT) may mean that current sensing data changes with respect to previous sensing data (which may be stored, for example, in the memory 420), or may mean that current sensing data changes with respect to some predetermined or reference sensing data.

Through a comparison between property values or the changes in the property values of the driving transistors (DRT), a property value deviation between driving transistors (DRT) may be grasped or determined. When the change in the property value of the driving transistor (DRT) means that the current sensing data has changed with respect to the reference sensing data, the property value deviation (for example, subpixel brightness deviation) between driving transistors (DRT) may be grasped or determined from the change in the property value of the driving transistor (DRT).

The property value compensation process may include threshold voltage compensation processing of compensating for the threshold voltage of the driving transistor (DRT) and mobility compensation processing of compensating for the mobility of the driving transistor (DRT).

The threshold voltage compensation processing may include calculating a compensation value for compensating for the threshold voltage or the threshold voltage deviation (threshold voltage change) and storing the calculated compensation value in the memory 420 or changing corresponding image data (Data) based on the calculated compensation value.

The mobility compensation processing may include calculating a compensation value for compensating for the mobility or the mobility deviation (mobility change) and storing the calculated compensation value in the memory 420 or changing corresponding image data (Data) based on the calculated compensation value.

The compensation unit 430 may change the image data (Data) through the threshold voltage compensation processing or the mobility compensation processing and supply the changed data (e.g., compensated data) to the corresponding SDIC within the data driver 120.

Accordingly, the corresponding SDIC may convert the data changed by the compensation unit 430 into a data voltage through a Digital to Analog Converter (DAC) and supply the data voltage to the corresponding subpixel, thereby actually compensating for the subpixel property values (e.g., compensating for the threshold value and the mobility).

As the compensation for the subpixel property values is performed, the brightness deviation between subpixels may be reduced or prevented, and a picture quality may be improved.

Figure 7:
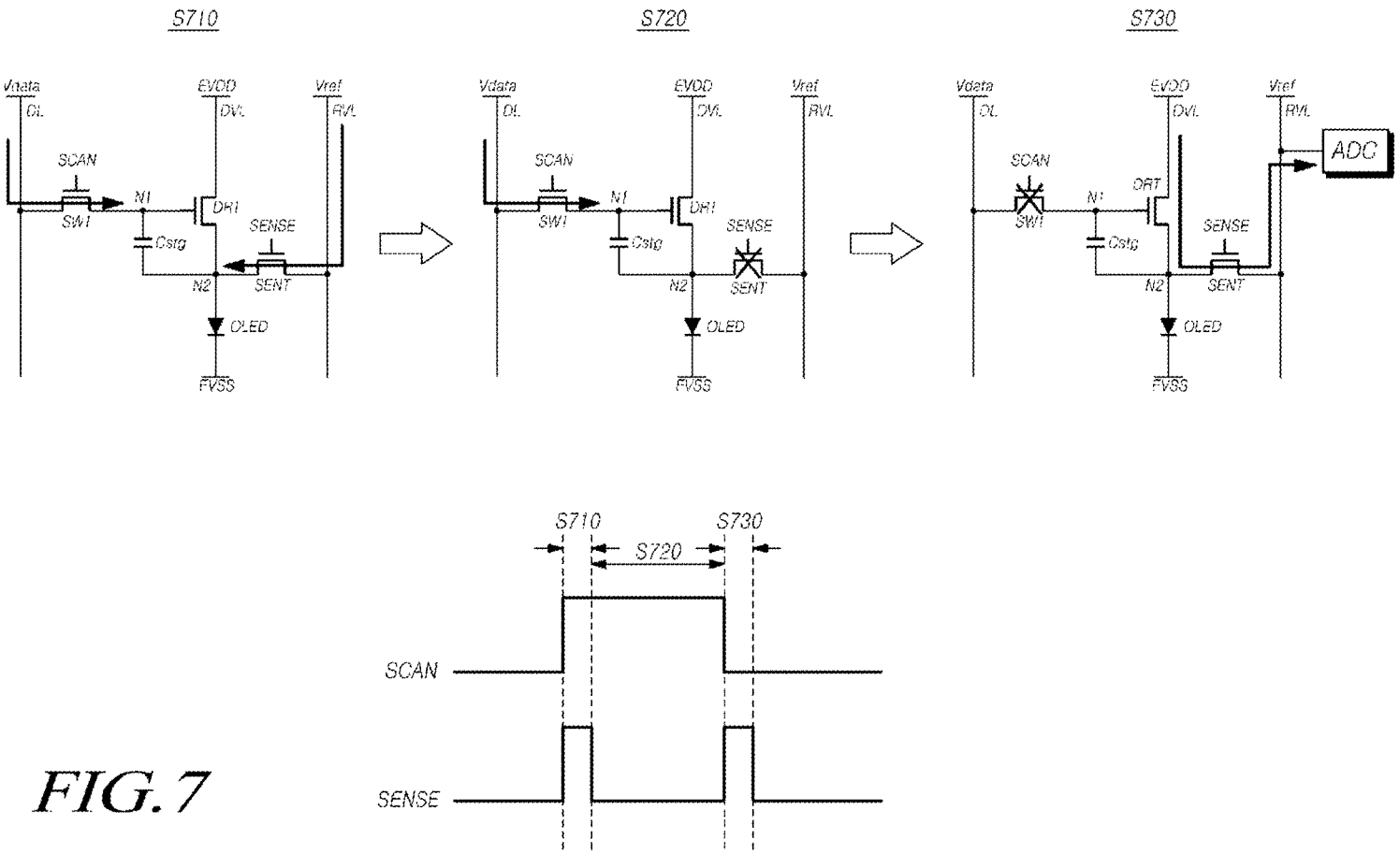
FIG. 7 is a diagram illustrating a degradation sensing driving scheme of an organic light emitting diode of an organic light emitting display device according to one or more embodiments.

FIG. 7 illustrates a degradation sensing driving method of the organic light emitting diode (OLED) of the organic light emitting display device 100 according to one or more embodiments.

Referring to FIG. 7, organic light emitting diode (OLED) degradation sensing driving may include an initialization step S710 of initializing the first node (N1) and the second node (N2) of the driving transistor (DRT), an organic light emitting diode (OLED) degradation tracking step S720 of tracking degradation of the organic light emitting diode (OLED), and an organic light emitting diode (OLED) degradation sensing step S730 of sensing a voltage indicating a degradation degree of the organic light emitting diode (OLED).

In the initialization step S710, both the switching transistor (SWT) and the sensing transistor (SENT) are turned on, and the first node (N1) and the second node (N2) of the driving transistor (DRT) are initialized into a data voltage (Vdata) and a reference voltage (Vref) for sensing the degradation of the organic light emitting diode (OLED).

In the organic light emitting diode (OLED) degradation tracking step S720, only the sensing transistor (SENT) is turned off and the second node (N2) of the driving transistor (DRT) is floated, and thus the voltage of the second node (N2) of the driving transistor (DRT) is changed.

In the organic light emitting diode (OLED) degradation tracking step S720, the voltage of the second node (N2) of the driving transistor (DRT) increases and then the organic light emitting diode (OLED) emits light.

The voltage of the second node (N2) of the driving transistor (DRT) when the organic light emitting diode (OLED) emits light varies depending on the degradation degree of the organic light emitting diode (OLED).

Accordingly, in the organic light emitting diode (OLED) degradation sensing step S730, the switching transistor SWT is turned off and the sensing transistor (SENT) is turned on, and thus the voltage of the second node (N2) of the driving transistor (DRT) may be detected through the sensing unit 410, which may be an Analog to Digital Converter (ADC), and the degradation degree of the organic light emitting diode (OLED) may be sensed.

As described above, the organic light emitting display device 100 according to one or more embodiments may provide an image driving mode for displaying a general image, a driving transistor threshold voltage compensation mode for sensing a threshold voltage of the driving transistor (DRT) and compensating for the threshold voltage, a driving transistor mobility compensation mode for sensing and compensating for mobility of the driving transistor (DRT), and an afterimage compensation mode for sensing and compensating for degradation (threshold voltage) of the organic light emitting diode (OLED).

The image driving mode, the driving transistor threshold voltage compensation mode, and the driving transistor mobility compensation mode can be executed in both cases where the subpixel corresponds to either the 1-scan structure or the 2-scan structure (e.g., as shown in FIG. 3).

However, in the afterimage compensation mode, the switching transistor (SWT) and the sensing transistor (SENT) should be individually controlled, so the afterimage compensation mode cannot normally be applied to the 1-scan structure and can be applied only to the 2-scan structure.

However, when the subpixels are designed in the 2-scan structure, it is impossible to avoid reduction in the aperture ratio.

The following description, however, provides embodiments in which the afterimage compensation mode can be applied in a 1-scan structure.

Figure 8:
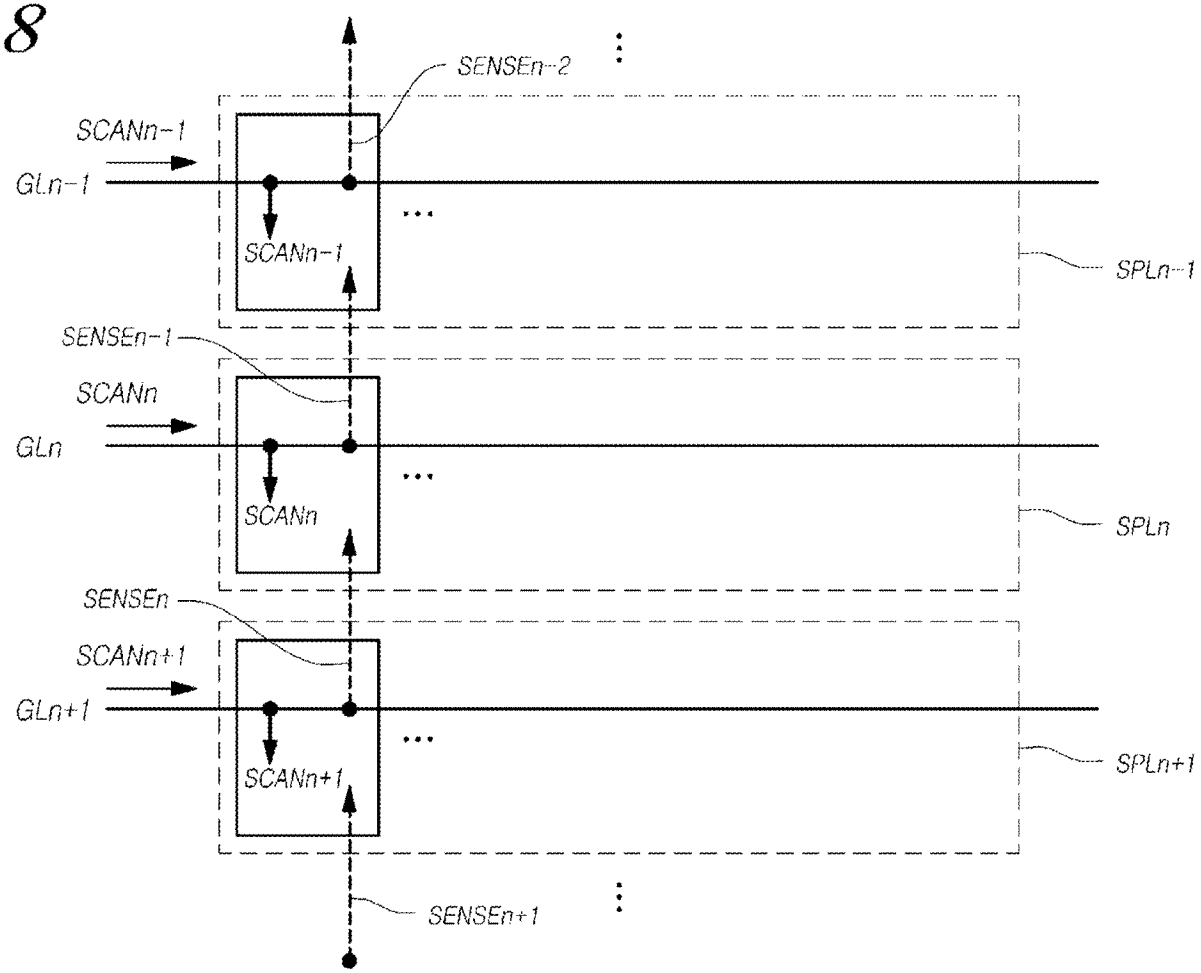
FIGS. 8 and 9 illustrate an improved structure of an organic light emitting display panel according to one or more embodiments.
Figure 9:
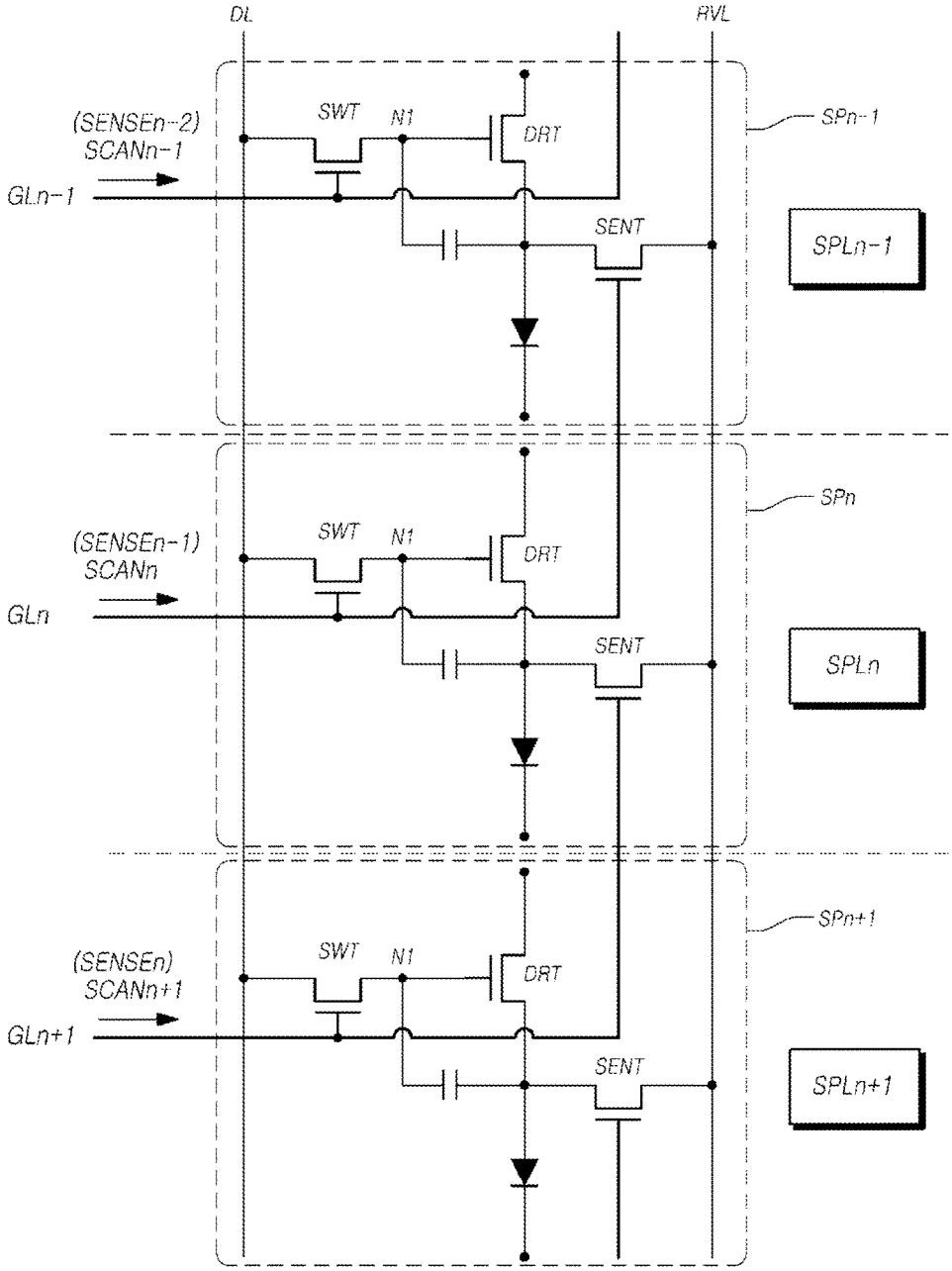

FIGS. 8 and 9 illustrate improved structures of the organic light emitting display panel 110 according to one or more embodiments.

As described above, each subpixel includes the organic light emitting diode (OLED), the driving transistor (DRT) for driving the organic light emitting diode (OLED), the switching transistor (SWT) controlled by the scan signal (SCAN) applied to the gate node and electrically connected between the first node (N1) of the driving transistor (DRT) and the data line (DL), the sensing transistor (SENT) controlled by the sensing signal (SENSE) and electrically connected between the second node (N2) of the driving transistor (DRT) and the reference voltage line (RVL), and the storage capacitor (Cstg) electrically connected between the first node (N1) and the second node (N2) of the driving transistor (DRT).

Referring to FIGS. 8 and 9, a plurality of subpixel lines ( . . . , SPLn−1, SPLn, SPLn+1, . . . ) and a plurality of gate lines ( . . . , GLn−1, GLn, GLn+1, . . . ) are arranged on the organic light emitting display panel 110.

Referring to FIGS. 8 and 9, each of the plurality of gate lines ( . . . , GLn−1, GLn, GLn+1, . . . ) are arranged on a respective subpixel line.

Referring to FIGS. 8 and 9, among the plurality of gate lines ( . . . , GLn−1, GLn, GLn+1, . . . ), the $n^{th}$ gate line (GLn) arranged on the $n^{th}$ subpixel line (SPLn) may be connected in common to a gate node of the switching transistor (SWT) within each subpixel (SPn) arranged on the $n^{th}$ subpixel line (SPLn) and a gate node of the sensing transistor (SENT) within each subpixel (SPn−1) arranged on the $n-1^{th}$ subpixel line (SPLn−1). That is, the gate line (GLn) that is provided across a row of subpixels (e.g., the $n^{th}$ subpixel line (SPLn)) is coupled to the gate node of the switching transistor (SWT) for each respective subpixel in the row, and is further coupled to the gate node of the sensing transistor (SENT) for each respective subpixel in a preceeding, adjacent row of subpixels (e.g., the $n-1^{th}$ subpixel line (SPLn−1)).

Among the plurality of gate lines ( . . . , GLn−1, GLn, GLn+1, . . . ), the $n+1^{th}$ gate line (GLn+1) arranged on the $n+1^{th}$ subpixel line (SPLn+1) may be connected in common to a gate node of the switching transistor (SWT) within each subpixel (SPn+1) arranged on the $n+1^{th}$ subpixel line (SPLn+1) and a gate node of the sensing transistor (SENT) within each subpixel (SPn) arranged on the $n-1^{th}$ subpixel line (SPLn).

Based on the aforementioned gate line connection structure, the 1-scan structure in which the switching transistor (SWT) and the sensing transistor (SENT) can be individually turned on and off may be made in accordance with embodiments provided herein.

Through the 1-scan structure, it is possible to execute various driving modes (for example, the afterimage compensation mode) that requires individual on and off control of the switching transistor (SWT) and the sensing transistor (SENT) while increasing the aperture ratio (as compared, for example, to the 2-scan structure).

According to the aforementioned gate line structure, the gate node of each of the switching transistor (SWT) and the sensing transistor (SENT) within each subpixel may be applied in the following type.

Referring to FIGS. 8 and 9, the gate node of the switching transistor (SWT) within each subpixel (SPn−1) arranged on the $n-1^{th}$ subpixel line (SPLn−1) receives an $n-1^{th}$ scan signal (SCANn−1) output through the $n-1^{th}$ gate line (GLn−1) arranged on the $n-1^{th}$ subpixel line (SPLn−1).

The gate node of the sensing transistor (SENT) within each subpixel (SPn−1) arranged on the n−1$^{th}$ subpixel line (SPLn−1) receives an n$^{th}$ scan signal (SCANn) output through the n$^{th}$ gate line (GLn) arranged on the n$^{th}$ subpixel line (SPLn) as the n−1$^{th}$ sensing signal (SENSEn−1). That is, the scan signal (e.g., SCANn) provided to control the sensing transistors (SENT) of subpixels in a particular row also serves as the sense signal (e.g., SENSEn−1) that is provided to control the sensing transistors (SENT) of subpixels in a preceeding, adjacent row.

Referring to FIGS. 8 and 9, the gate node of the switching transistor (SWT) within each subpixel (SPn) arranged on the n$^{th}$ subpixel line (SPLn) receives the n$^{th}$ scan signal (SCANn) output through the n$^{th}$ gate line (GLn) arranged on the n$^{th}$ subpixel line (SPLn).

The gate node of the sensing transistor (SENT) within each subpixel (SPn) arranged on the n$^{th}$ subpixel line (SPLn) receives an n+1$^{th}$ scan signal (SCANn+1) output through the n+1$^{th}$ gate line (GLn+1) arranged on the n+1$^{th}$ subpixel line (SPLn+1) as the n$^{th}$ sensing signal (SENSEn).

According to the above described scheme, it is possible to individually control on and off of the switching transistor (SWT) and the sensing transistor (SENT) through only one gate line arranged on each subpixel line, that is, the 1-scan structure by individually providing the gate signals (SCAN and SENSE) to the switching transistor (SWT) and the sensing transistor (SENT) within each subpixel, respectively.

Accordingly, it is possible to execute a driving mode (for example, the afterimage compensation mode) that requires individual on and off control of the switching transistor (SWT) and the sensing transistor (SENT) while increasing the aperture ratio through the 1-scan structure.

Hereinafter, the four driving modes (i.e., the image driving mode, the afterimage compensation mode, the driving transistor threshold voltage compensation mode, and the driving transistor mobility compensation mode) according to the above described gate line structure will be described.

Figure 10:
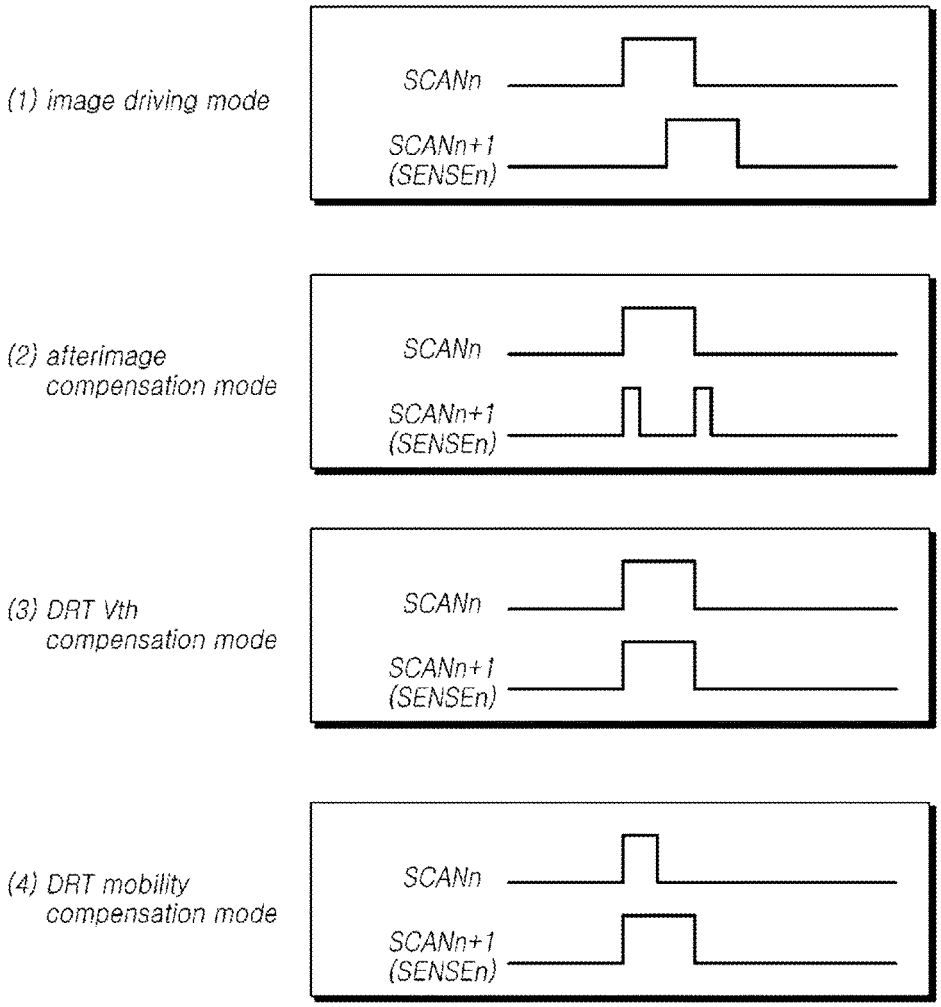
FIG. 10 is a scan signal timing diagram according to four driving modes in the improved structure of the organic light emitting display panel according to one or more embodiments.

FIG. 10 is a scan signal timing diagram according to four driving modes (an image driving mode, an afterimage compensation mode, a driving transistor threshold voltage compensation mode, and a driving transistor mobility compensation mode) in an improved structure of the organic light emitting display panel 110 according to one or more embodiments. The scan signal timing diagram of FIG. 10 is illustrated based on an n$^{th}$ subpixel line (SPLn).

Referring to FIG. 10, in the image driving mode for the n$^{th}$ subpixel line (SPLn), a turned-on level voltage interval of an n$^{th}$ scan signal (SCANn) and a turned-on level voltage interval of an n+1$^{th}$ scan signal (SCANn+1) may partially overlap each other.

Referring to FIG. 10, in the afterimage compensation mode for the n$^{th}$ subpixel line (SPLn), while the n$^{th}$ scan signal (SCANn) is output with the turned-on level voltage, the n+1$^{th}$ scan signal (SCANn+1) is output with the turned-on level voltage and then output with the turned-off level voltage and, when the n$^{th}$ scan signal (SCANn) is output with the turned-off level voltage changed from the turned-on level voltage, the n+1$^{th}$ scan signal (SCANn+1) may again be output with the turned-on level voltage.

Referring to FIG. 10, in the driving transistor (DRT) threshold voltage compensation mode for the n$^{th}$ subpixel line (SPLn), the turned-on level voltage interval of the n$^{th}$ scan signal (SCANn) and the turned-on level voltage interval of the n+1$^{th}$ scan signal (SCANn+1) may fully or partially overlap each other.

Referring to FIG. 10, in the driving transistor (DRT) mobility compensation mode for the n$^{th}$ subpixel line (SPLn), while the n+1$^{th}$ scan signal (SCANn+1) is output with the turned-on level voltage, the n$^{th}$ scan signal (SCANn) may be output with the turned-on level voltage and then output with the turned-off level voltage.

When the switching transistor (SWT) and the sensing transistor (SENT) are n-type transistors, the turned-on level voltage may be a high level gate voltage (VGH) and the turned-off level voltage may be low level gate voltage (VGL).

When the switching transistor (SWT) and the sensing transistor (SENT) are p-type transistors, the turned-on level voltage may be the low level gate voltage (VGL) and the turned-off level voltage may be the high level gate voltage (VGH).

FIGS. 11 to 14 are diagrams illustrating driving subpixels in the image driving mode under the improved structure of the organic light emitting display panel 110 according to one or more embodiments.

Figure 11:
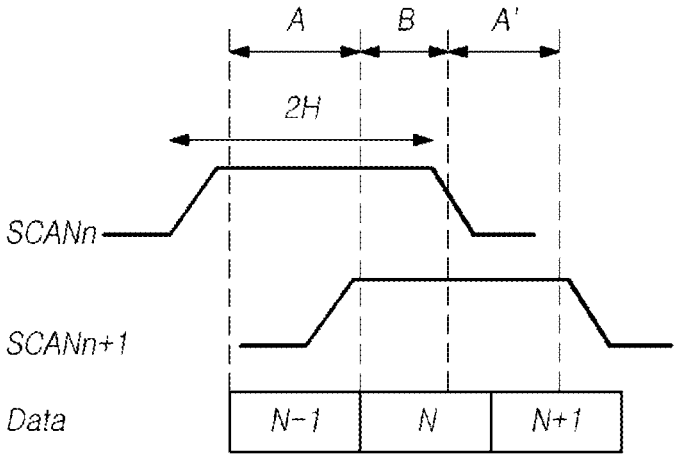
FIGS. 11 to 14 are diagrams illustrating driving of subpixels according to an image driving mode under the improved structure of the organic light emitting display panel according to one or more embodiments.

Referring to FIG. 11, each scan signal for image driving has a turned-on level voltage interval of a 2H length.

Referring to FIG. 11, an image driving mode interval for the n$^{th}$ subpixel line (SPLn) includes a timing margin securing interval (A) and a charging interval (B).

Figure 12:
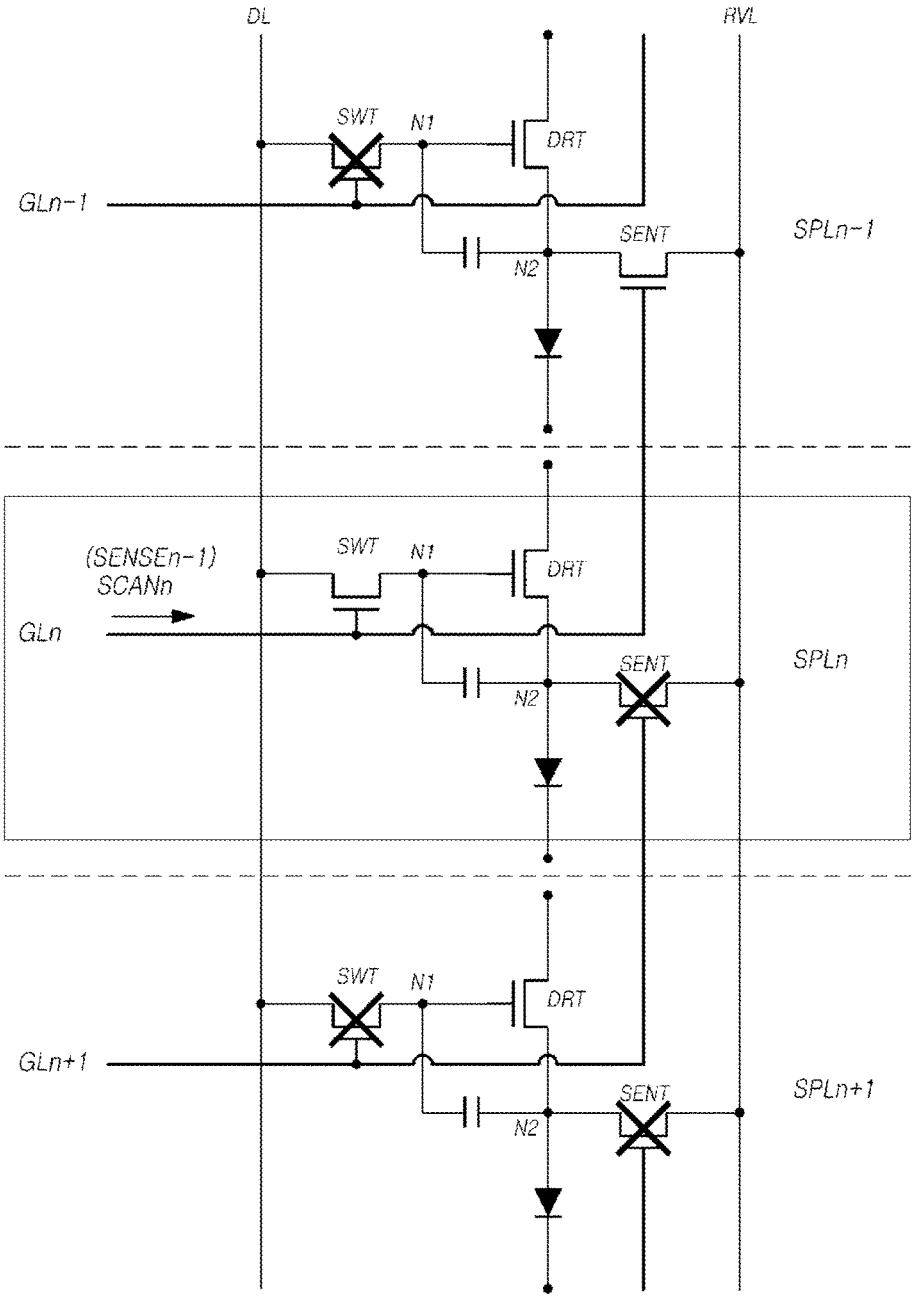

Referring to FIGS. 11 and 12, in the image driving mode for the n$^{th}$ subpixel line (SPLn), only the switching transistor (SWT) between the switching transistor (SWT) and the sensing transistor (SENT) within each subpixel (SPn) arranged on the n$^{th}$ subpixel line (SPLn) is turned on by the turned-on level voltage of the n$^{th}$ scan signal (SCANn) output from the n$^{th}$ gate line (GLn) arranged on the n$^{th}$ subpixel line (SPLn) during the timing margin securing interval A.

Accordingly, a data voltage for image driving is applied to a first node (N1) of the driving transistor (DRT).

The timing margin securing interval (A) is a necessary timing interval since the n$^{th}$ sensing signal (SENSEn) applied to the gate node of the sensing transistor (SENT) within each subpixel (SPn) arranged on the n$^{th}$ subpixel line (SPLn) corresponds to the n+1$^{th}$ scan signal (SCANn+1) output from the n+1$^{th}$ gate line (GLn+1) arranged on the n+1$^{th}$ subpixel line (SPLn+1).

Figure 13:
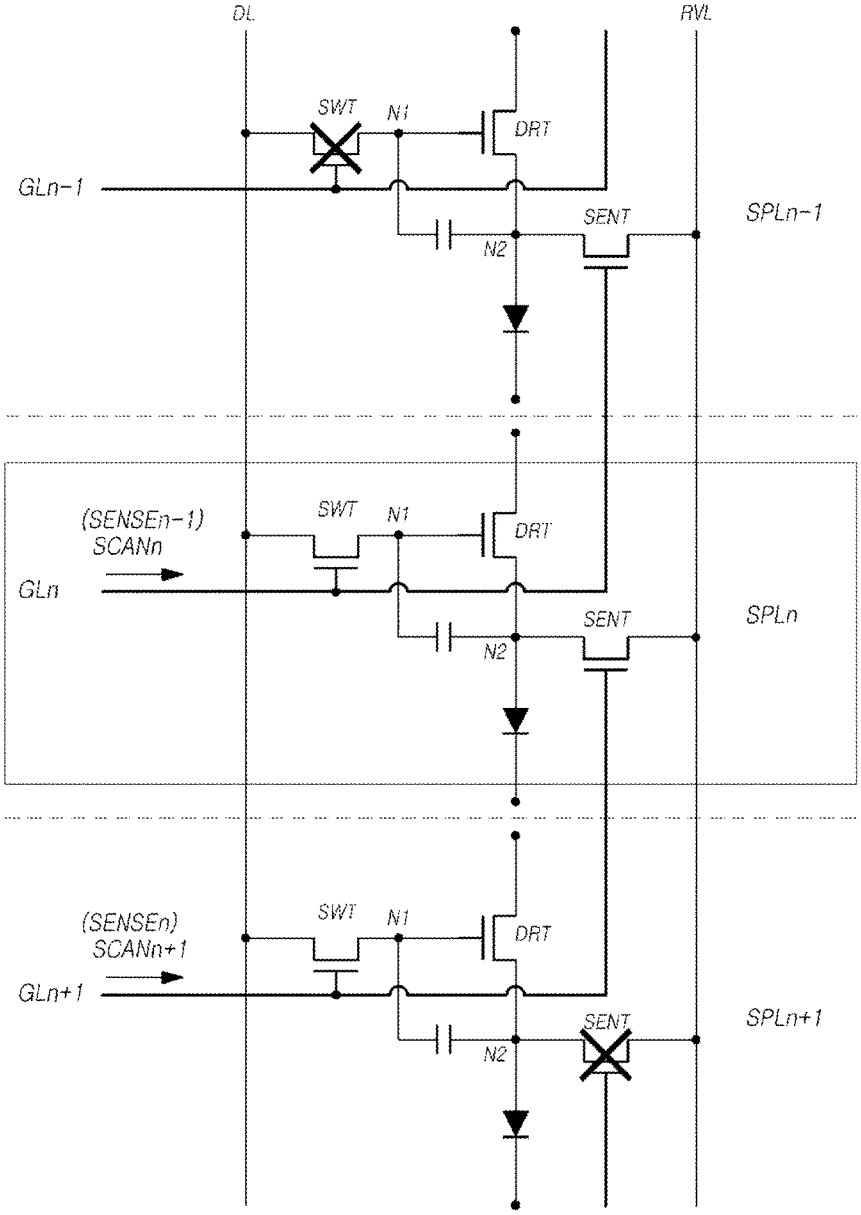

Referring to FIGS. 11 and 13, the sensing transistor (SENT) within each subpixel (SPn) arranged on the n$^{th}$ subpixel line (SPLn) is additionally turned on by the turned-on level voltage of the n+1$^{th}$ scan signal (SCANn+1) serving as the n$^{th}$ sensing signal (SENSEn) during the charging interval (B).

Accordingly, the data voltage for image driving and a reference voltage are applied to the first node (N1) and the second node (N2) of the driving transistor (DRT), and a voltage corresponding to a potential difference between the first node (N1) and the second node (N2) of the driving transistor (DRT) is charged in the storage capacitor (Cstg).

Thereafter, when the switching transistor (SWT) within each subpixel (SPn) arranged on the n$^{th}$ subpixel line (SPLn) is turned off by the turned-off level voltage of the n$^{th}$ scan signal (SCANn) and the sensing transistor (SENT) within each subpixel (SPn) arranged on the n$^{th}$ subpixel line (SPLn) is turned off by the turned-off level voltage of the n+1$^{th}$ scan signal (SCANn+1) serving as the n$^{th}$ sensing signal (SENSEn) and thus both the first node (N1) and the second node (N2) of the driving transistor (DRT) are floated, the voltage of the second node (N2) of the driving transistor (DRT) increases, a current is supplied to the organic light emitting diode (OLED), and the OLET emits a light.

Figure 14:
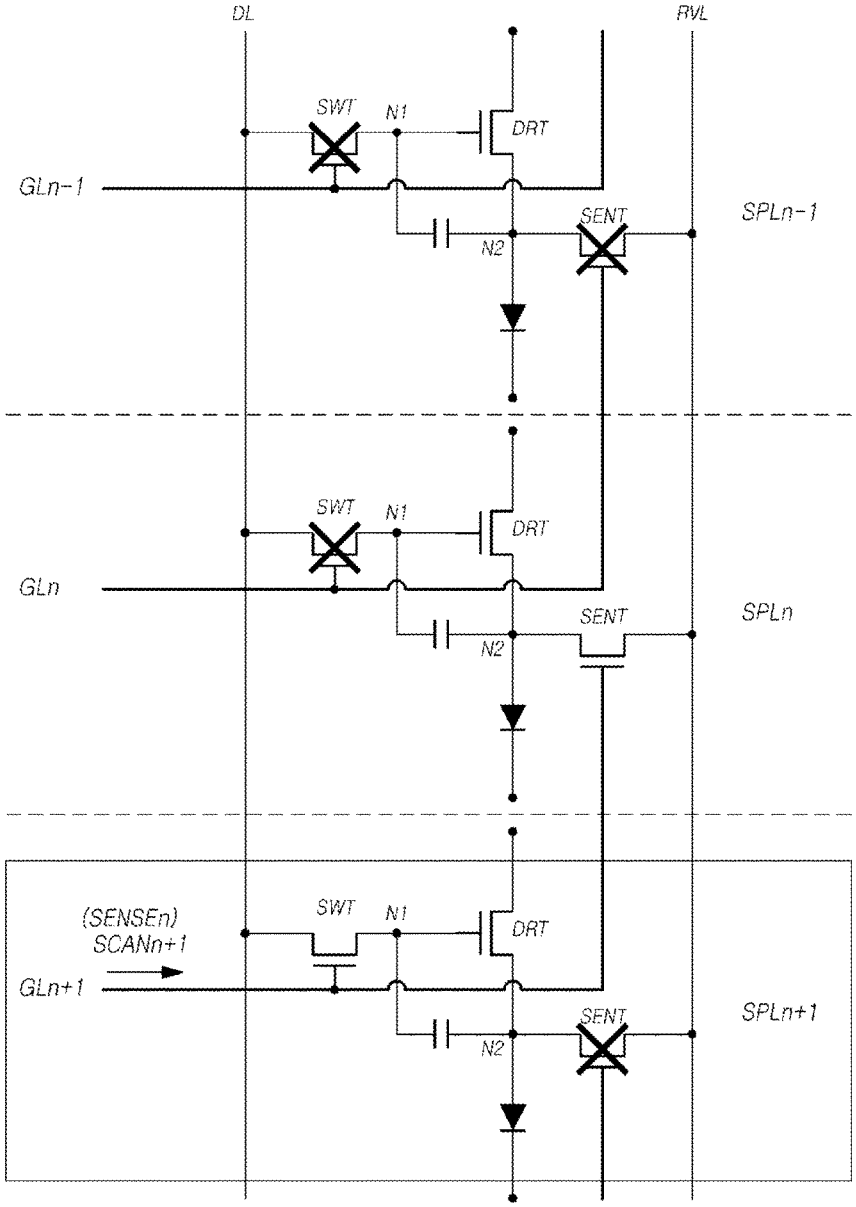

Meanwhile, referring to FIGS. 11 and 14, in the image driving mode for the $n^{th}$ subpixel line (SPLn), the switching transistor (SWT) within each subpixel (SPn) arranged on the $n^{th}$ subpixel line (SPLn) is turned off by the turned-off level voltage of the $n^{th}$ scan signal (SCANn) output from the $n^{th}$ gate line (GLn) in an A' interval after the charging interval (B). In the A' interval, the sensing transistor (SENT) within each subpixel (SPn) arranged on the $n^{th}$ subpixel line (SPLn) remains in the turned-on state. Such an A' interval may correspond to a timing margin securing interval for the image driving mode for the $n+1^{th}$ subpixel line (SPLn+1).

As described above, in the image driving mode for the $n^{th}$ subpixel line (SPLn), the turned-on level voltage interval of an $n^{th}$ scan signal (SCANn) and the turned-on level voltage interval of the $n+1^{th}$ scan signal (SCANn+1) may partially overlap each other.

That is, in the image driving mode for the $n^{th}$ subpixel line (SPLn), the second half of the turned-on level voltage interval of an $n^{th}$ scan signal (SCANn) and the first half of the turned-on level voltage interval of the $n+1^{th}$ scan signal (SCANn+1) may partially overlap each other.

Accordingly, even though the $n+1^{th}$ scan signal (SCANn+1) output from the $n+1^{th}$ gate line (GLn+1) arranged on the $n+1^{th}$ subpixel line (SPLn+1) is used as the $n^{th}$ sensing signal (SENSEn) applied to the gate node of the sensing transistor (SENT) within each subpixel (SPn) arranged on the $n^{th}$ subpixel line (SPLn), normal image driving may be possible.

Figure 15:
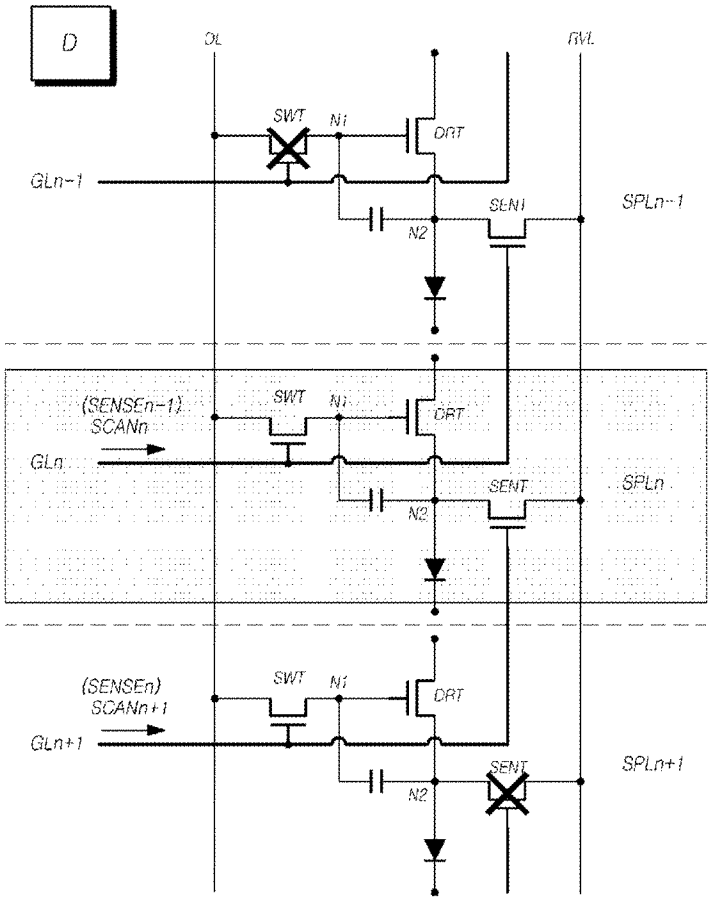
FIGS. 15 to 17 are diagrams illustrating driving of subpixels according to an afterimage compensation mode under the improved structure of the organic light emitting display panel according to one or more embodiments.
Figure 15:
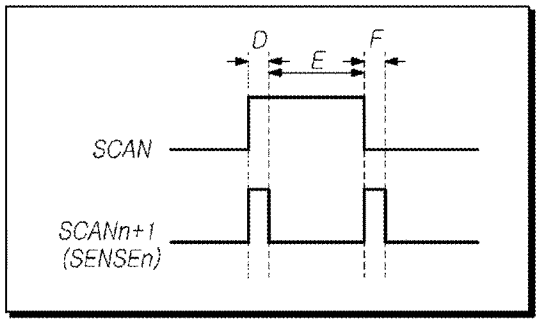
Figure 16:
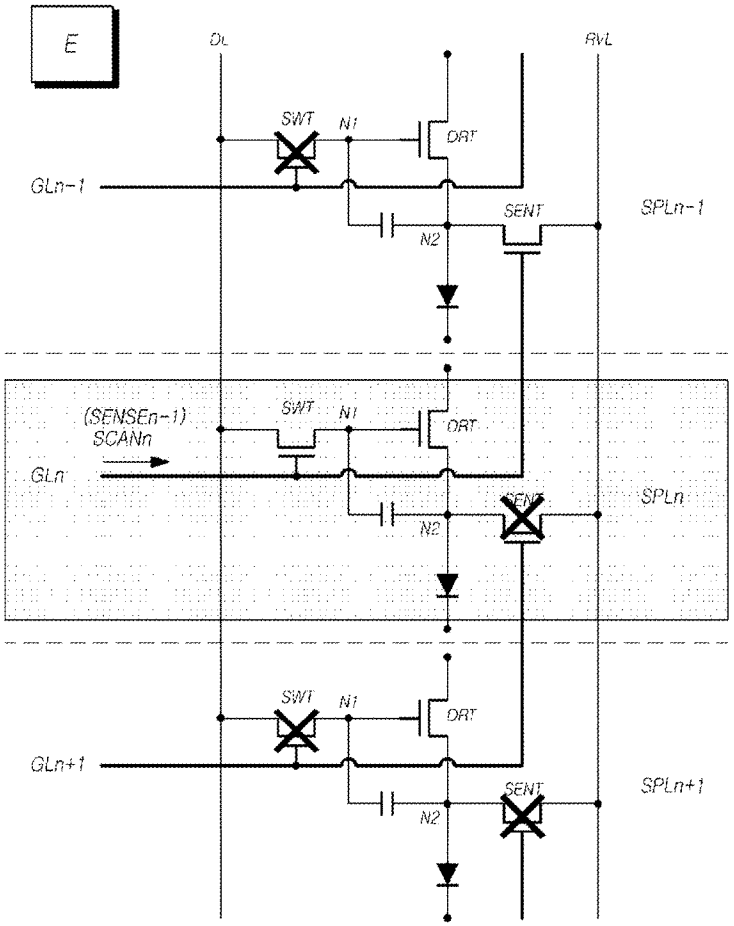
Figure 16:
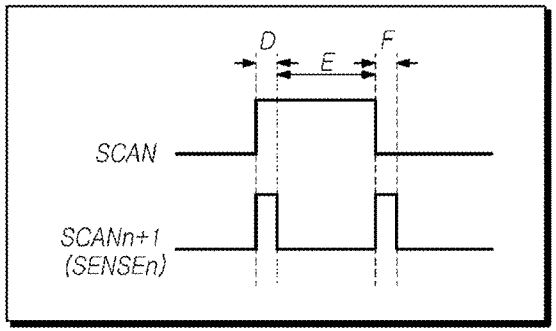
Figure 17:
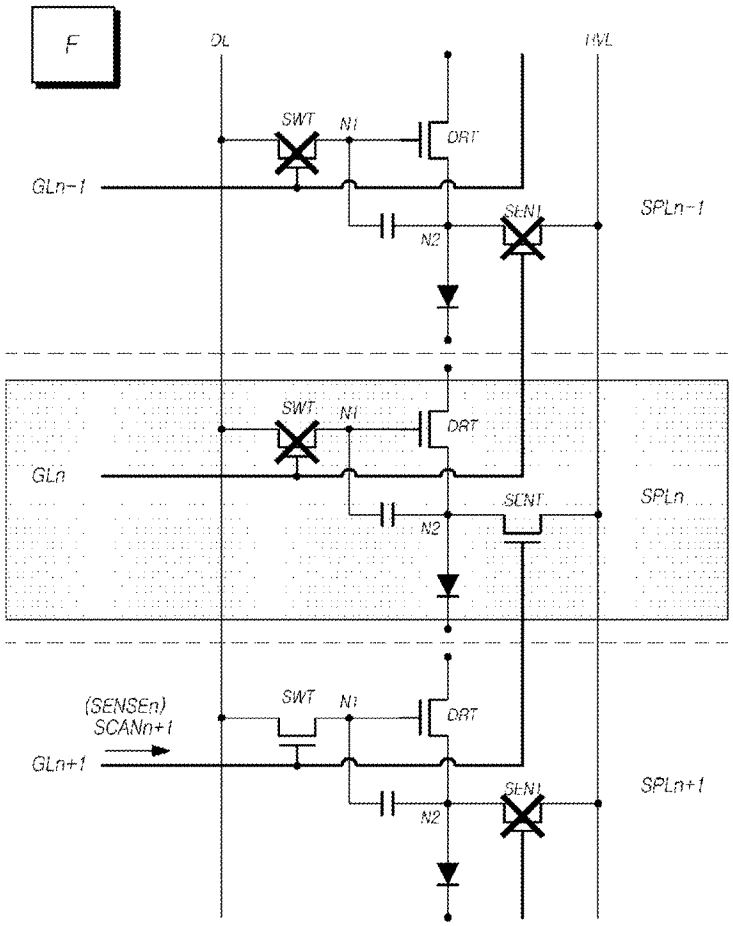
Figure 17:
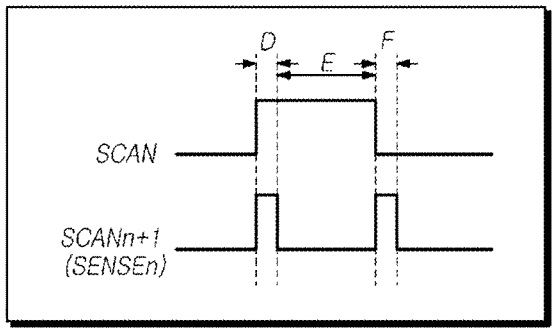

FIGS. 15 to 17 are diagrams illustrating driving of subpixels according to an afterimage compensation mode (OLED degradation compensation mode through OLED degradation sensing) under the improved structure of the organic light emitting display panel 110 according to one or more embodiments.

Referring to FIGS. 15 to 17, the afterimage compensation mode may proceed to an initialization step D of initializing the first node (N1) and the second node (N2) of the driving transistor (DRT), an organic light emitting diode (OLED) degradation tracking step E of tracking degradation of the organic light emitting diode (OLED), and an organic light emitting diode (OLED) degradation sensing step F of sensing a voltage indicating a degradation degree of the organic light emitting diode (OLED).

Referring to FIG. 15, in the initialization step D, both the switching SWT and the sensing transistor (SENT) are turned on, and the first node (N1) and the second node (N2) of the driving transistor (DRT) are initialized into a data voltage (Vdata) and a reference voltage (Vref), respectively, for sensing the degradation of the organic light emitting diode (OLED).

At this time, the switching transistor (SWT) within the subpixel (SPn) arranged on the $n^{th}$ subpixel line (SPLn) is turned on by the turned-on level voltage of the $n^{th}$ scan signal (SCANn) output from the $n^{th}$ gate line (GLn) arranged on the $n^{th}$ subpixel line (SPLn).

Further, the sensing transistor (SENT) within the subpixel (SPn) arranged on the $n^{th}$ subpixel line (SPLn) is turned on by the turned-on level voltage of the $n+1^{th}$ scan signal (SCANn+1) output from the $n+1^{th}$ gate line (GLn+1) arranged on the $n+1^{th}$ subpixel line (SPLn+1).

In the organic light emitting diode (OLED) degradation tracking step E (shown in FIG. 16), only the sensing transistor (SENT) is turned off and the second node (N2) of the driving transistor (DRT) is floated, and thus the voltage of the second node (N2) of the driving transistor (DRT) is changed.

At this time, the sensing transistor (SENT) within the subpixel (SPn) arranged on the $n^{th}$ subpixel line (SPLn) is turned off by the turned-off level voltage of the $n+1^{th}$ scan signal (SCANn+1) output from the $n+1^{th}$ gate line (GLn+1) arranged on the $n+1^{th}$ subpixel line (SPLn+1).

In the organic light emitting diode (OLED) degradation tracking step E, the voltage of the second node (N2) of the driving transistor (DRT) increases and then the organic light emitting diode (OLED) emits light.

The voltage of the second node (N2) of the driving transistor (DRT) when the organic light emitting diode (OLED) emits light varies depending on the degradation degree of the organic light emitting diode (OLED).

Accordingly, in the organic light emitting diode (OLED) degradation sensing step F (shown in FIG. 17), the switching transistor (SWT) is turned off and the sensing transistor (SENT) is turned on, and thus the voltage of the second node (N2) of the driving transistor (DRT) may be detected through the sensing unit 410, which may be or include an Analog to Digital Converter (ADC), and the degradation degree of the organic light emitting diode (OLED) may be sensed.

At this time, the switching transistor (SWT) within the subpixel (SPn) arranged on the $n^{th}$ subpixel line (SPLn) is turned off by the turned-off level voltage of the $n^{th}$ scan signal (SCANn) output from the $n^{th}$ gate line (GLn) arranged on the $n^{th}$ subpixel line (SPLn).

Further, the sensing transistor (SENT) within the subpixel (SPn) arranged on the $n^{th}$ subpixel line (SPLn) is turned on by the turned-on level voltage of the $n+1^{th}$ scan signal (SCANn+1) output from the $n+1^{th}$ gate line (GLn+1) arranged on the $n+1^{th}$ subpixel line (SPLn+1).

Referring to FIGS. 15 to 17, in the afterimage compensation mode for the $n^{th}$ subpixel line (SPLn), while the $n^{th}$ scan signal (SCANn) is output with the turned-on level voltage (D and E), the $n+1^{th}$ scan signal (SCANn+1) is output with the turned-on level voltage in the step D and then output with the turned-off level voltage in the step E.

Further, referring to FIGS. 15 to 17, in the step F, when the $n^{th}$ scan signal (SCANn) is output with the changed turned-off level voltage, the $n+1^{th}$ scan signal (SCANn+1) is output with the turned-on level voltage.

According to the above description, through the 1-scan structure in which the switching transistor (SWT) and the sensing transistor (SENT) can be individually turned on and off, degradation sensing driving of the OLED for after image compensation can be performed.

Figure 18:
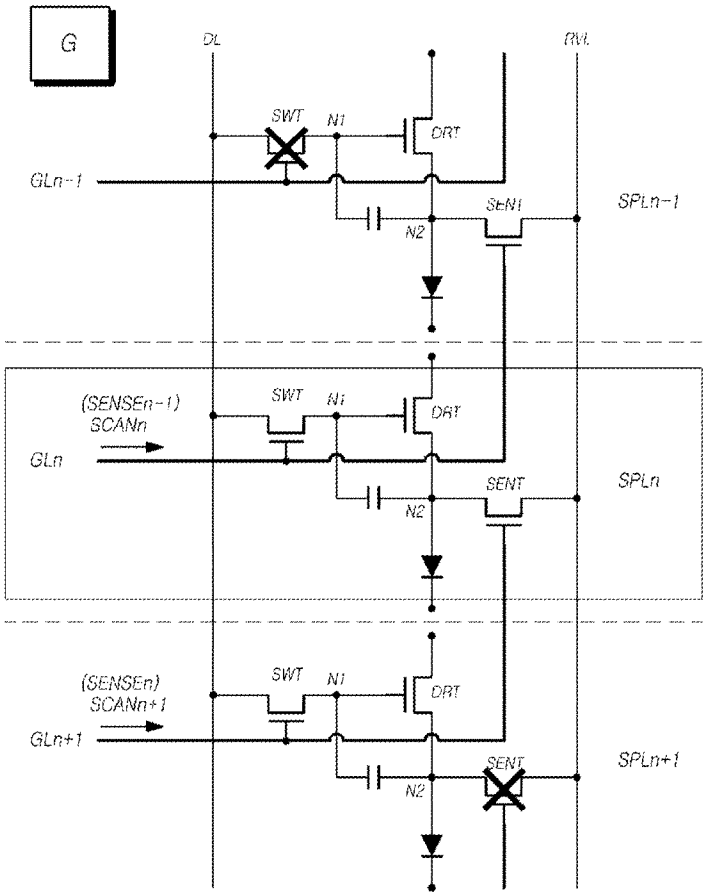
FIG. 18 is a diagram illustrating driving of subpixels according to a driving transistor threshold voltage compensation mode under the improved structure of the organic light emitting display panel according to one or more embodiments.
Figure 18:
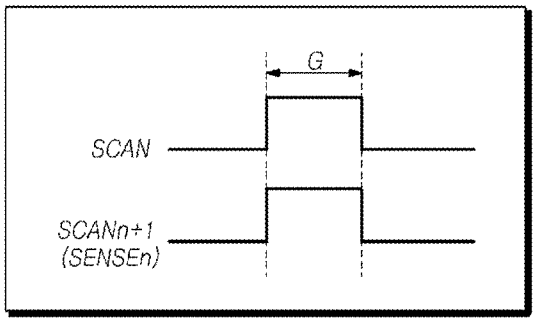

FIG. 18 is a diagram illustrating driving of subpixels according to a driving transistor (DRT) threshold voltage compensation mode under the improved structure of the organic light emitting display panel 110 according to one or more embodiments.

Referring to FIG. 18, during a G interval for the driving transistor threshold voltage compensation mode for compensating for a threshold voltage through threshold voltage sensing of the driving transistor (DRT), the switching transistor (SWT) within the subpixel (SPn) arranged on the $n^{th}$ subpixel line (SPLn) is turned on by the turned-on level voltage of the $n^{th}$ scan signal (SCANn) output from the $n^{th}$ gate line (GLn) arranged on the $n^{th}$ subpixel line (SPLn).

Further, during the G interval, the sensing transistor (SENT) within the subpixel (SPn) arranged on the $n^{th}$ subpixel line (SPLn) is turned on by the turned-on level voltage of the $n+1^{th}$ scan signal (SCANn+1) output from the $n+1^{th}$ gate line (GLn+1) arranged on the $n+1^{th}$ subpixel line (SPLn+1).

Accordingly, the first node (N1) and the second node (N2) of the driving transistor (DRT) are initialized into the data voltage for threshold voltage sensing and the reference voltage, respectively.

After the G interval, the switching transistor (SWT) within the subpixel (SPn) arranged on the $n^{th}$ subpixel line (SPLn) is turned off by the turned-off level voltage of the $n^{th}$ scan signal (SCANn) output from the $n^{th}$ gate line (GLn) arranged on the $n^{th}$ subpixel line (SPLn).

At this time, the sensing transistor (SENT) within the subpixel (SPn) arranged on the $n^{th}$ subpixel line (SPLn) is also turned off by the turned-off level voltage of the $n+1^{th}$ scan signal (SCANn+1) output from the $n+1^{th}$ gate line (GLn+1) arranged on the $n+1^{th}$ subpixel line (SPLn+1).

Further, the G interval may include a step of increasing the voltage of the second node (N2) of the driving transistor (DRT) within the subpixel (SPn) arranged on the $n^{th}$ subpixel line (SPLn) by turning off the initialization switch (SPRE) of FIG. 4 and a step in which, when the voltage of the second node (N2) of the driving transistor (DRT) is saturated, the sampling switch (SAM) is turned on and the sensing unit 410 senses the saturated voltage of the second node (N2) of the driving transistor (DRT) through the reference voltage line (RVL).

As described above, in the driving transistor (DRT) threshold voltage compensation mode for the $n^{th}$ subpixel line (SPLn), the turned-on level voltage interval of the $n^{th}$ scan signal (SCANn) and the turned-on level voltage interval of the $n+1^{th}$ scan signal (SCANn+1) may fully or partially overlap each other.

According to such a driving scheme, the driving transistor threshold voltage compensation may be provided in the same way even under a particular gate line connection structure according to embodiments provided herein.

Figure 19:
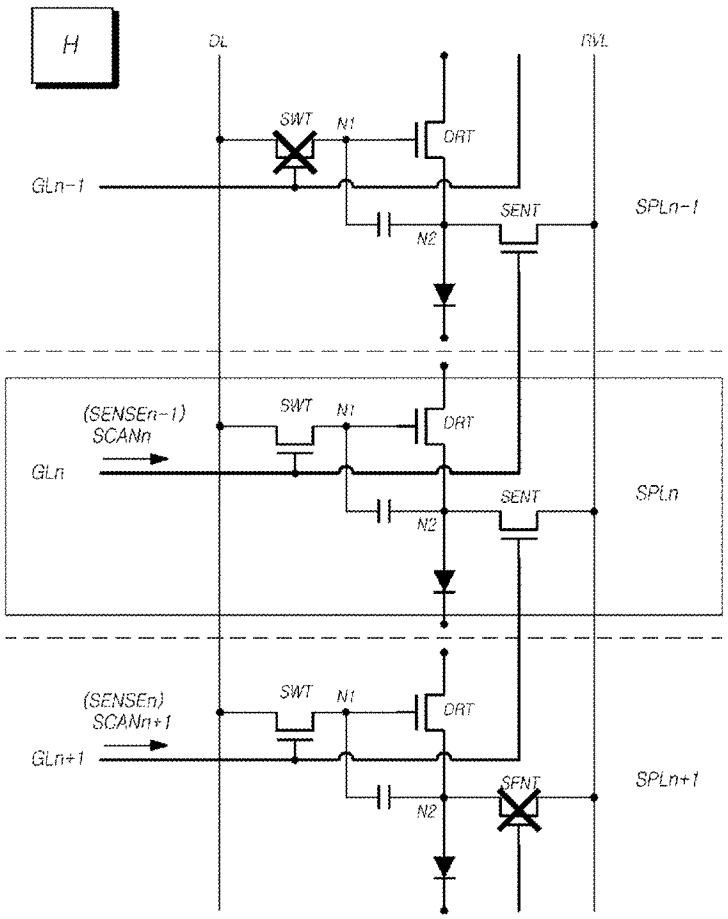
FIGS. 19 and 20 are diagrams illustrating driving of subpixels according to a driving transistor mobility compensation mode under the improved structure of the organic light emitting display panel according to one or more embodiments.
Figure 19:
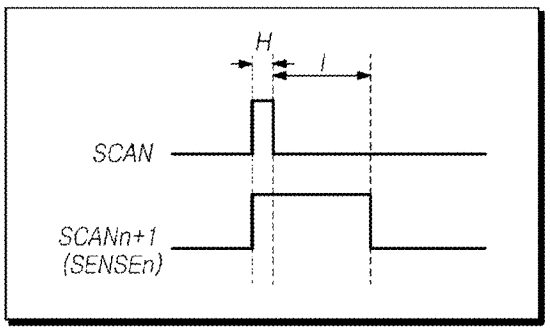
Figure 20:
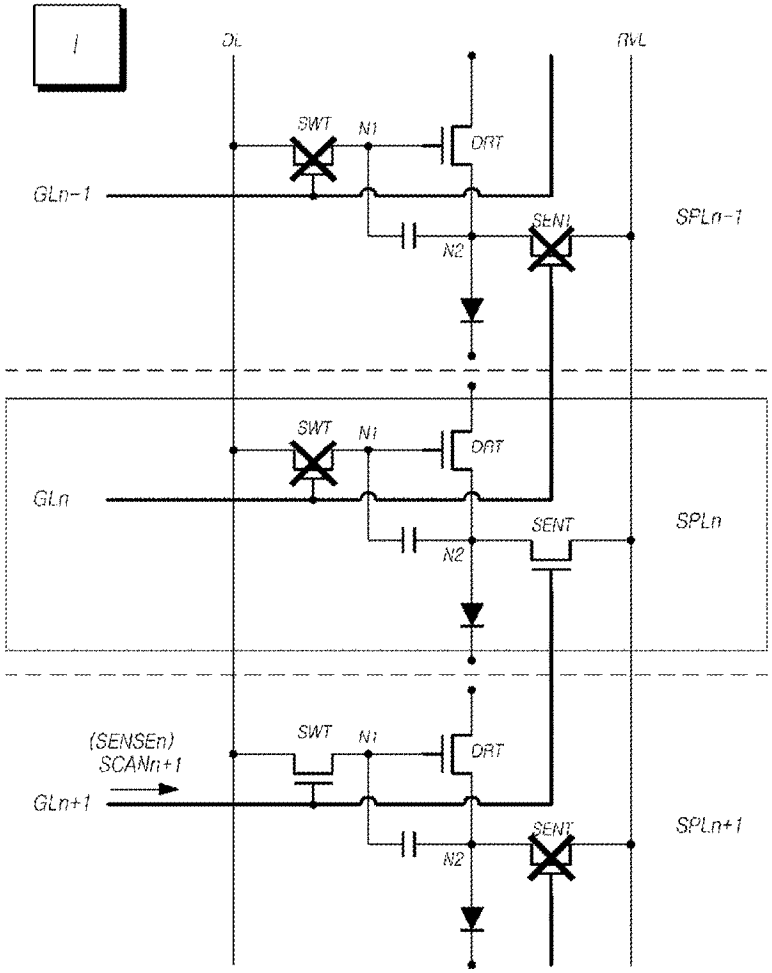
Figure 20:
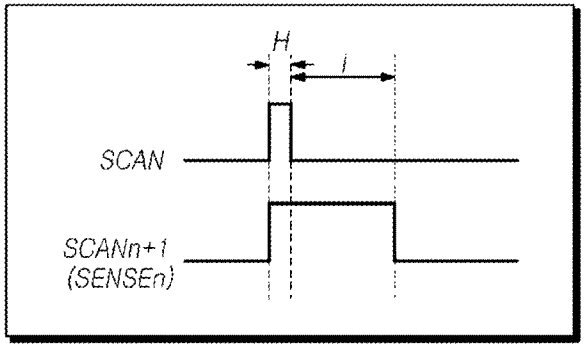

FIGS. 19 and 20 are diagrams illustrating driving of subpixels according to a driving transistor (DRT) mobility compensation mode under the improved structure of the organic light emitting display panel 110 according to one or more embodiments.

Referring to FIG. 19, during an H interval corresponding to the initialization step for the driving transistor mobility compensation mode for compensating for the threshold voltage through mobility sensing of the driving transistor (DRT), the switching transistor (SWT) within the subpixel (SPn) arranged on the $n^{th}$ subpixel line (SPLn) is turned on by the turned-on level voltage of the $n^{th}$ scan signal (SCANn) output from the $n^{th}$ gate line (GLn) arranged on the $n^{th}$ subpixel line (SPLn).

Further, during the H interval, the sensing transistor (SENT) within the subpixel (SPn) arranged on the $n^{th}$ subpixel line (SPLn) is turned on by the turned-on level voltage of the $n+1^{th}$ scan signal (SCANn+1) output from the $n+1^{th}$ gate line (GLn+1) arranged on the $n+1^{th}$ subpixel line (SPLn+1).

During the H interval corresponding to the initialization step, the first node (N1) and the second node (N2) of the driving transistor (DRT) are initialized into the data voltage for mobility sensing and the reference voltage, respectively.

Thereafter, during an I interval (shown in FIG. 20), the switching transistor (SWT) within the subpixel (SPn) arranged on the $n^{th}$ subpixel line (SPLn) is turned off by the turned-off level voltage of the $n^{th}$ scan signal (SCANn) output from the $n^{th}$ gate line (GLn) arranged on the $n^{th}$ subpixel line (SPLn).

Accordingly, the first node (N1) of the driving transistor (DRT) within the subpixel (SPn) arranged on the $n^{th}$ subpixel line (SPLn) is floated.

Further, during the I interval, the second node (N2) of the driving transistor (DRT) within the subpixel (SPn) arranged on the $n^{th}$ subpixel line (SPLn) is floated by turning off the initialization switch (SPRE) of FIG. 4.

In addition, during the I interval, when the first node (N1) and the second node (N2) are floated and the voltage of each of the first node (N1) and the second node (N2) of the driving transistor (DRT) increases, after a predetermined time, the sampling switch (SAM) is turned on and the sensing unit 410 senses the voltage of the second node (N2) of the driving transistor (DRT) through the reference voltage line (RVL).

According to the above description, in the driving transistor (DRT) mobility compensation mode for the $n^{th}$ subpixel line (SPLn), while the $n+1^{th}$ scan signal (SCANn+1) is output with the turned-on level voltage, the $n^{th}$ scan signal (SCANn) may be output with the turned-on level voltage and then output with the turned-off level voltage.

According to such a driving scheme, the driving transistor mobility compensation may be provided in the same way even under a particular gate line structure according to embodiments provided herein.

According to the various embodiments provided by the present disclosure, it is possible to provide the organic light emitting display panel 110, the organic light emitting display device 100, and methods of driving the organic light emitting display device 100 having the subpixel structure and the gate line structure in which the aperture ratio can increase and image driving and various types of sensing driving can be performed.

According to embodiments provided herein, it is possible to provide the organic light emitting display panel 110, the organic light emitting display device 100, and methods of driving the organic light emitting display device 100 having the subpixel structure and the gate line connection structure in which two types of scan transistors (SWT and SENT) within each subpixel can be individually turned on and off through one gate line on each subpixel line.

According to embodiments provided herein, it is possible to provide the organic light emitting display panel 110, the organic light emitting display device 100, and methods of driving the organic light emitting display device 100 that can sense degradation of the organic light emitting diode within each subpixel through one gate line on each subpixel line.

The above description and the accompanying drawings provide examples of the technical idea of the present disclosure for illustrative purposes only. Those having ordinary knowledge in the technical field, to which the present disclosure pertains, will appreciate that various modifications and changes in form, such as combination, separation, substitution, and change of a configuration, are possible without departing from the essential features of the present disclosure. Therefore, the embodiments disclosed in the present disclosure are intended to illustrate the scope of the technical idea of the present disclosure, and the scope of the present disclosure is not limited by the particular embodiments described herein. The scope of the present disclosure shall be construed on the basis of the accompanying claims in such a manner that all of the technical ideas included within the scope equivalent to the claims belong to the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light emitting display device, comprising:

an organic light emitting display panel including a plurality of subpixels, a plurality of data lines and a plurality of gate lines, the subpixels being arranged into rows and columns, each row of the subpixels corresponding to a respective gate line and each column corresponding to a respective data line;

a data driver for driving the plurality of data lines;

a gate driver for driving the plurality of gate lines; and a controller for controlling the data driver and the gate driver, wherein each of the subpixels includes:

an organic light emitting diode, a driving transistor for driving the organic light emitting diode, a switching transistor controlled by a scan signal applied to a gate node of the switching transistor, the switching transistor electrically connected between a first node of the driving transistor and a respective data line, a sensing transistor controlled by a sensing signal applied to a gate node of the sensing transistor, the sensing transistor electrically connected between a second node of the driving transistor and a reference voltage line, and a storage capacitor electrically connected between the first node and the second node of the driving transistor, wherein the plurality of gate lines are each arranged on a respective subpixel row, and an $n+1^{th}$ gate line arranged on an $n+1^{th}$ subpixel row is connected in common to the gate node of the switching transistor within each subpixel of the $n+1^{th}$ subpixel row, and to the gate node of the sensing transistor within each subpixel of an $n^{th}$ subpixel row, wherein the gate node of the switching transistor within each subpixel of the $n^{th}$ subpixel row receives an $n^{th}$ scan signal output through an $n^{th}$ gate line arranged on the $n^{th}$ subpixel row, and the gate node of the sensing transistor within each subpixel of the $n^{th}$ subpixel row receives an $n+1^{th}$ scan signal output through the $n+1^{th}$ gate line arranged on the $n+1^{th}$ subpixel row as an $n^{th}$ sensing signal, wherein, in an afterimage compensation mode for the $n^{th}$ subpixel row, while the $n^{th}$ scan signal is output with a turned-on level voltage, the $n+1^{th}$ scan signal is changed into and output with the turned-on level voltage, and then is output with a turned-off level voltage, and, when the $n^{th}$ scan signal is changed into and output with the turned-off level voltage, the $n+1^{th}$ scan signal is output with the turned-on level voltage, wherein n is a natural number greater than zero.

2. The organic light emitting display device of claim 1, wherein, in an image driving mode for the $n^{th}$ subpixel row, a turned-on level voltage interval of the $n^{th}$ scan signal and a turned-on level voltage interval of the $n+1^{th}$ scan signal partially overlap each other.

3. The organic light emitting display device of claim 1, wherein, in a driving transistor threshold voltage compensation mode on the $n^{th}$ subpixel row, a turned-on level voltage interval of the $n^{th}$ scan signal and a turned-on level voltage interval of the $n+1^{th}$ scan signal overlap each other.

4. The organic light emitting display device of claim 1, wherein, in a driving transistor mobility compensation mode on the $n^{th}$ subpixel row, while the $n+1^{th}$ scan signal is output with a turned-on level voltage, the $n^{th}$ scan signal is output with the turned-on level voltage and then output with a turned-off level voltage.

5. An organic light emitting display panel comprising:

a plurality of data lines for supplying a data voltage;

a plurality of gate lines for supplying a gate signal; and a plurality of subpixels arranged in a matrix including rows and columns of subpixels, each of the plurality of gate lines being arranged on a respective subpixel row, wherein in each of the subpixels, an organic light emitting diode, a driving transistor for driving the organic light emitting diode, a switching transistor controlled by a scan signal applied to a gate node of the switching transistor and electrically connected between a first node of the driving transistor and a data line, a sensing transistor controlled by a sensing signal applied to a gate node of the sensing transistor and electrically connected between a second node of the driving transistor and a reference voltage line, and a storage capacitor electrically connected between the first node and the second node of the driving transistor are arranged, wherein an $n+1^{th}$ gate line arranged on an $n+1^{th}$ subpixel row is connected in common to the gate node of the switching transistor within each subpixel in the $n+1^{th}$ subpixel row and the gate node of the sensing transistor within each subpixel in an $n^{th}$ subpixel row, wherein the gate node of the switching transistor within each subpixel in the $n^{th}$ subpixel row receives an $n^{th}$ scan signal output through an $n^{th}$ gate line arranged in the $n^{th}$ subpixel row, and the gate node of the sensing transistor within each subpixel in the $n^{th}$ subpixel row receives an $n+1^{th}$ scan signal output through the $n+1^{th}$ gate line arranged on the $n+1^{th}$ subpixel row as an $n^{th}$ sensing signal, wherein, in an afterimage compensation mode for the $n^{th}$ subpixel row, while the $n^{th}$ scan signal is output with a turned-on level voltage, the $n+1^{th}$ scan signal is changed into and output with the turned-on level voltage, and then is output with a turned-off level voltage, and, when the $n^{th}$ scan signal is changed into and output with the turned-off level voltage, the $n+1^{th}$ scan signal is output with the turned-on level voltage, wherein n is a natural number greater than zero.

6. The organic light emitting display panel of claim 5, wherein, in an image driving mode for the $n^{th}$ subpixel row, a turned-on level voltage interval of the $n^{th}$ scan signal and a turned-on level voltage interval of the $n+1^{th}$ scan signal partially overlap each other.

7. The organic light emitting display panel of claim 5, wherein, in a driving transistor threshold voltage compensation mode on the $n^{th}$ subpixel row, a turned-on level voltage interval of the $n^{th}$ scan signal and a turned-on level voltage interval of the $n+1^{th}$ scan signal overlap each other.

8. The organic light emitting display panel of claim 5, wherein, in a driving transistor mobility compensation mode on the $n^{th}$ subpixel row, while the $n+1^{th}$ scan signal is output with a turned-on level voltage, the $n^{th}$ scan signal is output with the turned-on level voltage and then output with a turned-off level voltage.

9. An image driving method of an organic light emitting display device in which a plurality of subpixels defined by a plurality of data lines and a plurality of gate lines are arranged, each of the subpixels including an organic light emitting diode, a driving transistor for driving the organic light emitting diode, a switching transistor controlled by a scan signal applied to a gate node of the switching transistor and electrically connected between a first node of the driving transistor and the data line, a sensing transistor controlled by a sensing signal applied to a gate node of the sensing transistor and electrically connected between a second node of the driving transistor and a reference voltage line, a display panel on which a storage capacitor electrically connected between the first node and the second node of the driving transistor is arranged, a data driver for driving the plurality of data lines, and a gate driver for driving the plurality of gate lines, the image driving method comprising:

turning on the switching transistor within each subpixel arranged on an $n^{th}$ subpixel line by providing a turned-on level voltage of an $n^{th}$ scan signal output from an $n^{th}$ gate line arranged on the $n^{th}$ subpixel line;

turning on the sensing transistor within each subpixel arranged on the $n^{th}$ subpixel line by providing a turned-on level voltage of an $n+1^{th}$ scan signal output from an $n+1^{th}$ gate line arranged on an $n+1^{th}$ subpixel line; and turning off the switching transistor within each subpixel arranged on the $n^{th}$ subpixel line by providing a turned-off level voltage of the $n^{th}$ scan signal output from the $n^{th}$ gate line, wherein in each of the subpixels, an organic light emitting diode, a driving transistor for driving the organic light emitting diode, a switching transistor controlled by a scan signal applied to a gate node of the switching transistor and electrically connected between a first node of the driving transistor and a data line, a sensing transistor controlled by a sensing signal applied to a gate node of the sensing transistor and electrically connected between a second node of the driving transistor and a reference voltage line, and a storage capacitor electrically connected between the first node and the second node of the driving transistor are arranged, wherein an $n+1^{th}$ gate line arranged on an $n+1^{th}$ subpixel row is connected in common to the gate node of the switching transistor within each subpixel in the $n+1^{th}$ subpixel row and the gate node of the sensing transistor within each subpixel in an $n^{th}$ subpixel row, wherein the gate node of the switching transistor within each subpixel in the $n^{th}$ subpixel row receives an $n^{th}$ scan signal output through an $n^{th}$ gate line arranged in the $n^{th}$ subpixel row, and the gate node of the sensing transistor within each subpixel in the $n+1^{th}$ subpixel row as an $n^{th}$ sensing signal, wherein, in an afterimage compensation mode for the $n^{th}$ subpixel row, while the $n^{th}$ scan signal is output with a turned-on level voltage, the $n+1^{th}$ scan signal is changed into and output with the turned-on level voltage, and then is output with a turned-off level voltage, and, when the $n^{th}$ scan signal is changed into and output with the turned-off level voltage, the $n+1^{th}$ scan signal is output with the turned-on level voltage, wherein n is a natural number greater than zero.

10. The image driving method of claim 9, wherein turning on the sensing transistor within each subpixel arranged on the $n^{th}$ subpixel line includes:

providing the turned-on level voltage of the $n+1^{th}$ scan signal while the turned-on level voltage of the $n^{th}$ scan signal is provided.

11. The image driving method of claim 10, wherein turning off the switching transistor within each subpixel arranged on the $n^{th}$ subpixel line includes:

providing the turned-off level voltage of the $n^{th}$ scan signal while the turned-on level voltage of the $n+1^{th}$ scan signal is provided.

12. An organic light emitting diode degradation sensing driving method of an organic light emitting display device in which a plurality of subpixels defined by a plurality of data lines and a plurality of gate lines are arranged, each of the subpixels including an organic light emitting diode, a driving transistor for driving the organic light emitting diode, a switching transistor controlled by a scan signal applied to a gate node of the switching transistor and electrically connected between a first node of the driving transistor and the data line, a sensing transistor controlled by a sensing signal applied to a gate node of the sensing transistor and electrically connected between a second node of the driving transistor and a reference voltage line, a display panel on which a storage capacitor electrically connected between the first node and the second node of the driving transistor is arranged, a data driver for driving the plurality of data lines, and a gate driver for driving the plurality of gate lines, the organic light emitting diode degradation sensing driving method comprising:

turning on the switching transistor within each subpixel arranged on an $n^{th}$ subpixel line by providing a turned-on level voltage of an $n^{th}$ scan signal output from an $n^{th}$ gate line arranged on the $n^{th}$ subpixel line, and turning on the sensing transistor within each subpixel arranged on the $n^{th}$ subpixel line by providing a turned-on level voltage of an $n+1^{th}$ scan signal output from an $n+1^{th}$ gate line arranged on an $n+1^{th}$ subpixel line;

turning off the sensing transistor within a subpixel arranged on the $n^{th}$ subpixel line by a turned-off level voltage of the $n+1^{th}$ scan signal output from the $n+1^{th}$ gate line; and turning off the switching transistor within each subpixel arranged on the $n^{th}$ subpixel line by providing a turned-off level voltage of the $n^{th}$ scan signal output from the $n^{th}$ gate line, and turning-on the sensing transistor within the subpixel arranged on the $n^{th}$ subpixel line by providing a turned-on level voltage of the $n+1^{th}$ scan signal output from the $n+1^{th}$ gate line, wherein in each of the subpixels, an organic light emitting diode, a driving transistor for driving the organic light emitting diode, a switching transistor controlled by a scan signal applied to a gate node of the switching transistor and electrically connected between a first node of the driving transistor and a data line, a sensing transistor controlled by a sensing signal applied to a gate node of the sensing transistor and electrically connected between a second node of the driving transistor and a reference voltage line, and a storage capacitor electrically connected between the first node and the second node of the driving transistor are arranged, wherein an $n+1^{th}$ gate line arranged on an $n+1^{th}$ subpixel row is connected in common to the gate node of the switching transistor within each subpixel in the $n+1^{th}$ subpixel row and the gate node of the sensing transistor within each subpixel in an $n^{th}$ subpixel row, wherein the gate node of the switching transistor within each subpixel in the $n^{th}$ subpixel row receives an $n^{th}$ scan signal output through an $n^{th}$ gate line arranged in the $n^{th}$ subpixel row, and the gate node of the sensing transistor within each subpixel in the $n^{th}$ subpixel row receives an $n+1^{th}$ scan signal output through the $n+1^{th}$ gate line arranged on the $n+1^{th}$ subpixel row as an $n^{th}$ sensing signal, wherein, in an afterimage compensation mode for the $n^{th}$ subpixel row, while the $n^{th}$ scan signal is output with a turned-on level voltage, the $n+1^{th}$ scan signal is changed into and output with the turned-on level voltage, and then is output with a turned-off level voltage, and, when the $n^{th}$ scan signal is changed into and output with the turned-off level voltage, the $n+1^{th}$ scan signal is output with the turned-on level voltage, wherein n is a natural number greater than zero.

13. The organic light emitting diode degradation sensing driving method of claim 12, wherein the turned-on level voltage of the $n^{th}$ scan signal and the turned-on level voltage of the $n+1^{th}$ scan signal are provided substantially simultaneously at a first timing.

14. The organic light emitting diode degradation sensing driving method of claim 13, wherein the turned-off level voltage of the $n^{th}$ scan signal and the turned-on level voltage of the $n+1^{th}$ scan signal are provided substantially simultaneously at a second timing.

* * * * *